US007736205B2

(12) United States Patent
Krah

(10) Patent No.: US 7,736,205 B2
(45) Date of Patent: Jun. 15, 2010

(54) HUMAN POWERED WATERCRAFT

(76) Inventor: Drew Allen Krah, 20429 Chautauqua Beach Rd. SW., Vashon, WA (US) 98070

( * ) Notice: Subject to any disclaimer, the term of this patent is extended or adjusted under 35 U.S.C. 154(b) by 336 days.

(21) Appl. No.: 11/977,224

(22) Filed: Oct. 23, 2007

(65) Prior Publication Data

US 2009/0104828 A1 Apr. 23, 2009

(51) Int. Cl.
*B63B 35/79* (2006.01)

(52) U.S. Cl. ..... 440/25; 440/15

(58) Field of Classification Search ..... 440/13–15, 440/25; 114/315

See application file for complete search history.

(56) References Cited

U.S. PATENT DOCUMENTS 3,254,622 A * 6/1966 Bramson ..... 440/22
3,361,106 A * 1/1968 Hildebrand ..... 440/15
5,816,871 A * 10/1998 Proverbio ..... 440/22

* cited by examiner

*Primary Examiner*—Ed Swinehart

(57) ABSTRACT

Human powered watercrafts, propulsion systems, and methods of propulsion are provided. A watercraft having an upper deck is configured with a cam plate having a pedal above the deck and a plate and cam below the deck, the cam engaging a cam follower of a fin bar, the fin bar having a substantially vertical propelling fin at an aft end and a pivot to the craft at a forward end. In another embodiment the craft receives two cam plates with pedals, a plurality of fin bars and two propelling fins, all operatively interconnected by a pulley and belt such that a leg thrust upon a pedal opens the fins and an opposite leg thrust upon the opposing pedal closes the fins, propelling the craft. In still another embodiment, an open, hollow surfboard remove-ably receives the propulsion system and a user activate-able buoyancy compensator making a submersible human powered watercraft.

6 Claims, 25 Drawing Sheets

16C

HUMAN POWERED WATERCRAFT

BACKGROUND

1. Field of the Invention

The field of invention is human powered watercraft. In the field of human powered watercraft, the body boarder who surfs the ocean waves, the diver who paddles from the beach to the kelp beds, the racer of human powered boats, and even that forlorn recreational boater whose vessel has sunken beneath him, all try to power themselves across the water by such meager resources as their own human engine and athletic grace allow. Whether to catch a wave, to get to a dive spot, to set a world human powered watercraft speed record, or simply to return oneself to the haven of land, each wants to optimally apply their human power and speed themselves and their craft thru the water. Therefore, in this context, power and speed properly applied can save a life, can set a personal best or even world speed record, can give access to hitherto inaccessible dive spots, and also, can yield a best wave ever ridden. A new human powered watercraft that enables the boater overboard to self rescue, that helps the body boarder to get more and better waves, that offers the racer a chance at a personal best, and that gets the diver to and from dive spots previously difficult to reach is a worthy invention. The new human powered watercraft and propulsion system of this invention will be welcomed by the community of watermen and women, beachgoers, cross-training athletes and the boating community and will be advantageously marketable in a hard or soft shelled surfboard embodiment in a broad niche centered between existing low end manufactured body boards and high dollar custom shaped surf boards. The broadness of the market niche will profitably encompass that of kayaks and racing shells, yet due to its inherent simplicity, the invention is readily adaptable to the scale economies of pool recreation devices and hobbyist's radio control models. Economically manufacture-able, compact, convenient, light weight, and fast, the invention ideally spans the product markets of board wave-riding devices, boater self-rescue craft, paddle boards for near shore divers, and speed record capable human powered watercraft.

2. Description of the Related Art

Krah, U.S. Pat. No. 7,232,350 propels a watercraft by a standing user thrusting a handle of a bar up and down, the bar connecting to a dagger board with a horizontal fin, the fin when not propelling stores in a recess in the watercraft. The invention does not allow leg powered propulsion from an essentially kneeling position as does the invention of this application.

Maisonneuve, U.S. Pat. No. 4,464,126 propels a surfboard by thrusting a lever forward and aft from a sitting position to drive a lower fin up and down. The system does not allow the surfer to move about the surfboard and the lower keel structure causes yaw instability with forward motion.

Chen, U.S. Pat. No. 6,468,118 propels a surfboard thru two foot treadles with an up and down leg motion deflecting separate fins. This system attaches the user to the board which can be dangerous when the board rolls over, somewhat entrapping the user.

Momot, U.S. Pat. No. 4,968,273 propels a surfboard with a single treadle driven fin using weight shifting forward and aft to propel the board. The system has a great deal of drag surface offered to the water, does not stow and so is constantly dragging down board speed.

Domancic, U.S. Pat. No. 5,549,491 propels a surfboard or boat by a single treadle driving two fins by a lateral, side to side weight shift. This motion is particularly destabilizing to a surfboard rider as the board is narrow and least stable laterally.

Malm, U.S. Pat. No. 3,377,977 propels a surfboard by a sculling-sweeping motion of a centrally pivoted oar. The lateral side to side motion of this system destabilizes the surfboard.

Ueno, U.S. Pat. No. 4,936,802 propels a surfboard by a single foot treadle driving a vertical fin to sweep laterally back and forth. The fin motion causes the boat or board to slough sideward without the stabilizing presence of a keel.

Ketterman, U.S. Pat. No. 6,022,249 propels a kayak via foot treadles that drive two flexible fins in opposing directions about the keel of the boat. The system is heavy and complex while also being subject to damage during beaching of the vessel as the fins are most exposed below the keel and users frequently forget to stow the system.

Puzey, U.S. Pat. No. 6,099,369 propels a tricycle hydrofoil by a bounding up and down motion of the user. The system suffers from the inability to start from the water and is unstable in yaw when in following seas.

Shiraki, U.S. Pat. No. 5,194,024 propels a surfboard via a pedal-crank propeller system operated by a recumbent seated rider. This and all recumbent systems impede the operator's ability to react to perturbing waves by limiting all but the users head from counteraction. As with other pedal and crank systems, the device is most efficient when one is clipped in and as stated previously, this makes emergency egress problematic and failed attempts to egress possibly fatal.

Gander, U.S. Pat. No. 4,304,555 propels a float device by a foot operated bell crank driven fish-fin. Absent a keel, the vehicle is unstable in yaw when propelled thusly.

Han, U.S. Pat. No. 6,033,276 propels a surfboard via a bell crank foot operated fish fin. The system causes the board to yaw during operation.

OBJECTS AND ADVANTAGES

The invention defined herein has substantial advantages over the prior art including but not limited to the following:

1) Higher speeds: In general, vessel speed goes up linearly with the square root of increased power. The present invention by virtue of using the legs for power generation exceeds that power available from the arms only by approaching 6 times. Arm powered paddling of surfboards yields a speed of at best 5 MPH. The square root of 6 being 2.44, times 5 MPH predicts a maximum displacing speed of 12.22 MPH although higher speeds are obtained due to hydroplaning.

2) The system enables a surfer to power out thru, over, and under breaking waves and white-water. By simply diving the board beneath the oncoming wave and continuing to leg thrust upon the pedals, the craft is propelled underwater. FIGS. 9, 10, and 11 illustrate this object and advantage.

3) Powering the system from a position upon the hands and feet requires very little metabolic exertion for the necessary underlying tasks of self-support and dynamic balance, freeing those unused metabolic resources for propulsion and enabling craft reductions in scale and weight which in turn enable higher speeds than are generally reachable by other craft.

4) The position of the user presents very little frontal aero drag area and drag surfaces to the wind freeing up metabolic resources for propulsion to higher speeds than those achievable by larger craft.

5) The watercraft minimizes weight and hydrodynamic drag thereby freeing up vital metabolic resources for propulsion. Other craft are heavy and have substantial mechanical clutter exposed to the sea. In one embodiment, this craft imposes only a hydroplaning surface and driving fins into the sea.

6) The user of the invention can be constantly in motion and, with no extremity remaining in the water so, one is less likely to attract the interest of a shark but if a predator is discovered, the user is able to quickly leave the area.

7) Fitness benefits are derived from the ability to continuously work-out rather than lying idle in the lineup of surfers.

8) Like a standard surfboard, it easily carries under one arm. Most human powered watercraft are ungainly and difficult to carry, and also require substantial set up time. In a surfboard embodiment, the invention of this application is convenient; simply grab and get in the water.

9) The invention is substantially lighter than many other human powered water-craft (HPW) and adds little weight above a normal surfboard mass.

10) Substantially less consumer expense than other mechanized HPW is possible due to the simplicity and compact size.

11) A surfboard powered thusly is far more maneuverable than any other mechanized human powered water craft.

12) By propelling from a kneeling position, greater user stability is achieved than other watercraft thereby increasing the safety of the user and those nearby.

13) The user is able to continuously adjust her center of gravity to maintain trim with respect to the board's center of buoyancy and hydrodynamic center of lift; this enables design reductions in size resulting in lower weights and lower manufacturer's costs and lower consumer costs than other larger and more complex human powered watercraft.

14) Reducing population density of surfers in a given locale is enabled because users of the invention will be catching waves easily at sites unattractive to traditional surfers.

15) Low manufacturers cost relative to larger systems simply by virtue of using less material and processing resources.

16) Greater acceleration and top-end speed will enable surfers and knee boarders to catch very large waves with no difficulty.

17) The system allows the user to continue propelling while riding the wave and so allows the surfer to get a ride on a weak wave where normally a surfer would be unable to continue paddling or riding on a weak and weakening wave.

18) Transports and stores easily like any other surf board and in substantially less space than other HPW.

19) Few parts to break down so low maintenance cost compared to other HPW.

20) Transportable on standard automobile surf racks and bike board-racks.

21) The craft may be propelled to depths and propelled at depths beneath the sea.

22) The surfboard embodiment with variable buoyancy means allows a surfer to increase or decrease her level of flotation and adapt to local wave conditions. Higher floatation of the user and board corresponds with reduced paddling exertion to catch a wave.

23) In a self-rescue watercraft embodiment, the invention can be tossed to a boater fallen overboard and used by her to power back toward the moving boat to intercept its path and so increase the chance of rescue. And, if no rescue boat is near but the user is close to land, the craft may be powered landward for hours at speeds beyond ten miles per hour, giving the user at least a reasonable chance at self-rescue.

SUMMARY OF THE INVENTION

In accordance with the present invention, a human powered watercraft has been designed which is in the form of a board of the shape and dimensions to serve as a surfboard, a race board, a dive board, a kneeboard, a boogey board, a rescue craft or small boat in an embodiment which may both be propelled upon and beneath the sea. The craft in a surfboard embodiment has a large hollow projecting from an aft opening to the sea forward to a position proximal the forward end of the surfboard; and the hollow surfaces are proximal respective surfboard outer surfaces. The hollow receives the propulsion means of the invention such that moving parts of the means are housed within the hollow and are lubricated by sea water generally, while the human interface of the human propulsion system, in the form of pedals project thru an opening in the deck of the surfboard and engage the user's feet. The surfboard further has pivot engaging apertures corresponding to like pivot engaging apertures in fin bars of the propulsion means and these apertures are generally forward on the craft and connect the hollow of the surfboard to the deck. The fin bars have cam followers to engage cam means in cam plates which cam plates are connected to the pedals above the deck, the cam plates and cams being below the deck and in the case of the surfboard embodiment housed within the hollow of the surfboard. The cam plates are operatively engaged and connected by a pulley and belt system where one belt end connects to one cam plate and the opposite belt end connects to the other cam plate, the pulley being rotate-ably engaged to the craft by a pivot thru apertures common to the pulley and the craft. The fin bars have vertical fins at aft fin bar portions and these fins may be flexible, rigid, or semi-rigid. The fins may be coupled to the fin bars by integrally molding the fins to the fin bars or may pivotally engage the fin bars. A fin may engage one fin bar or two fin bars in a pivoted configuration. In the configuration wherein one fin engages one fin bar, the fins are advantageously biased toward the long axis of the fin bar. In the configuration where a fin engages two fin bars, the fin and the two fin bars and the craft make up a four bar movement and the fin bars may be advantageously parallel, and the fin may be integrated to the propulsion system such that the fin is parallel to the craft longitudinal centerline. As best practiced, the system uses two sets of fin bars which are urged open and closed by the alternating pedal thrusts of a user; the opening and closing of the fin bars is horizontal about the beam of the craft and occurs in a symmetric and balanced, horizontally opposed fashion from and to the long axis of the craft. The novel design of this invention may be understood by reference to the accompanying drawings in which:

FIGS. 1, 2, and 3, show the watercraft of the invention being ridden by a user.

Figure 14A:
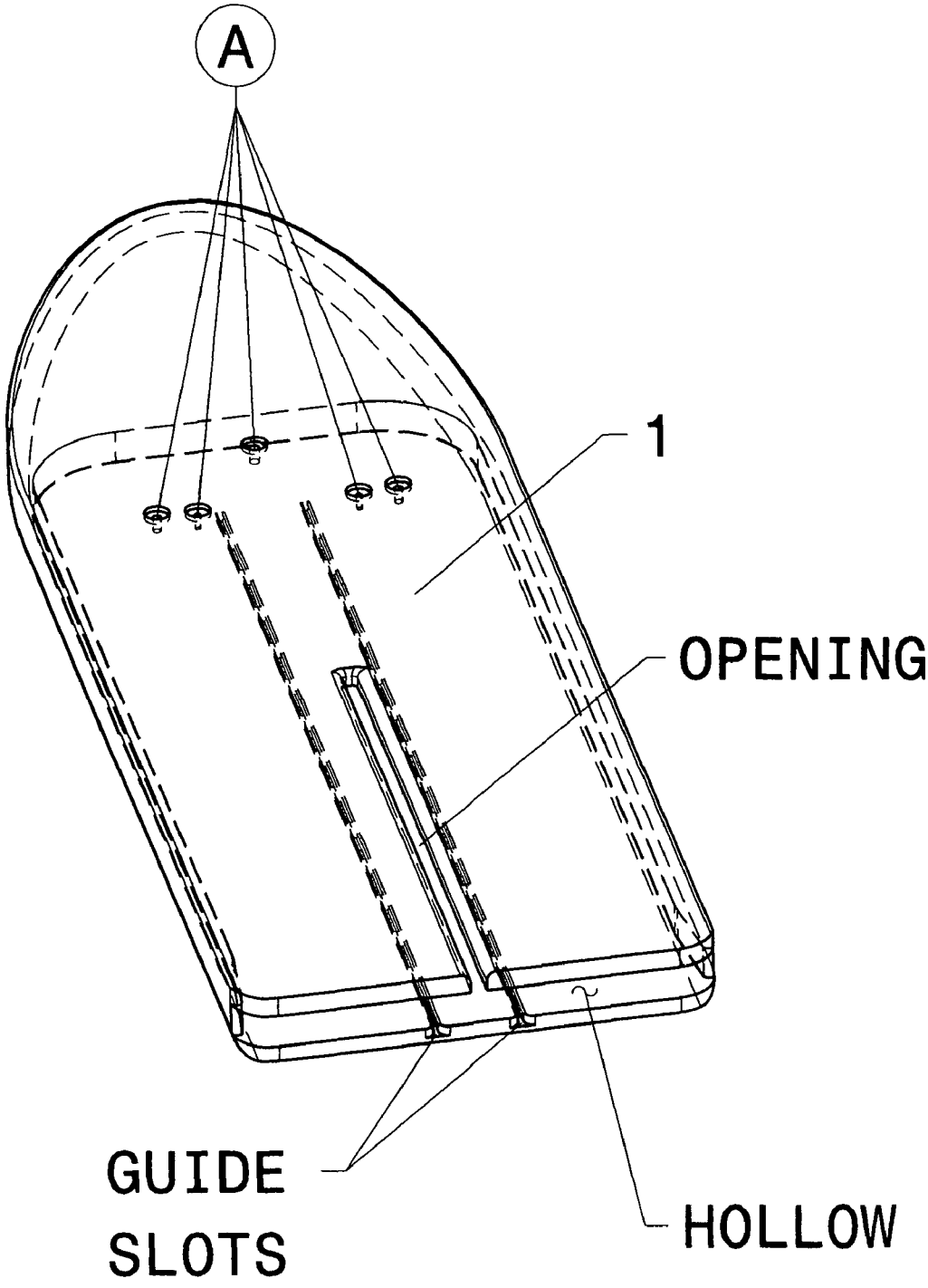

FIG. 14A shows a surfboard with a hollow surfboard portion, the hollow being open to the sea. Hidden lines are shown to reveal the internal definition of the hollow surfboard. The guide slots shown in the hollow are optional to the invention and are useful to guide cam plates of a configuration with guide ribs.

Figure 14B:
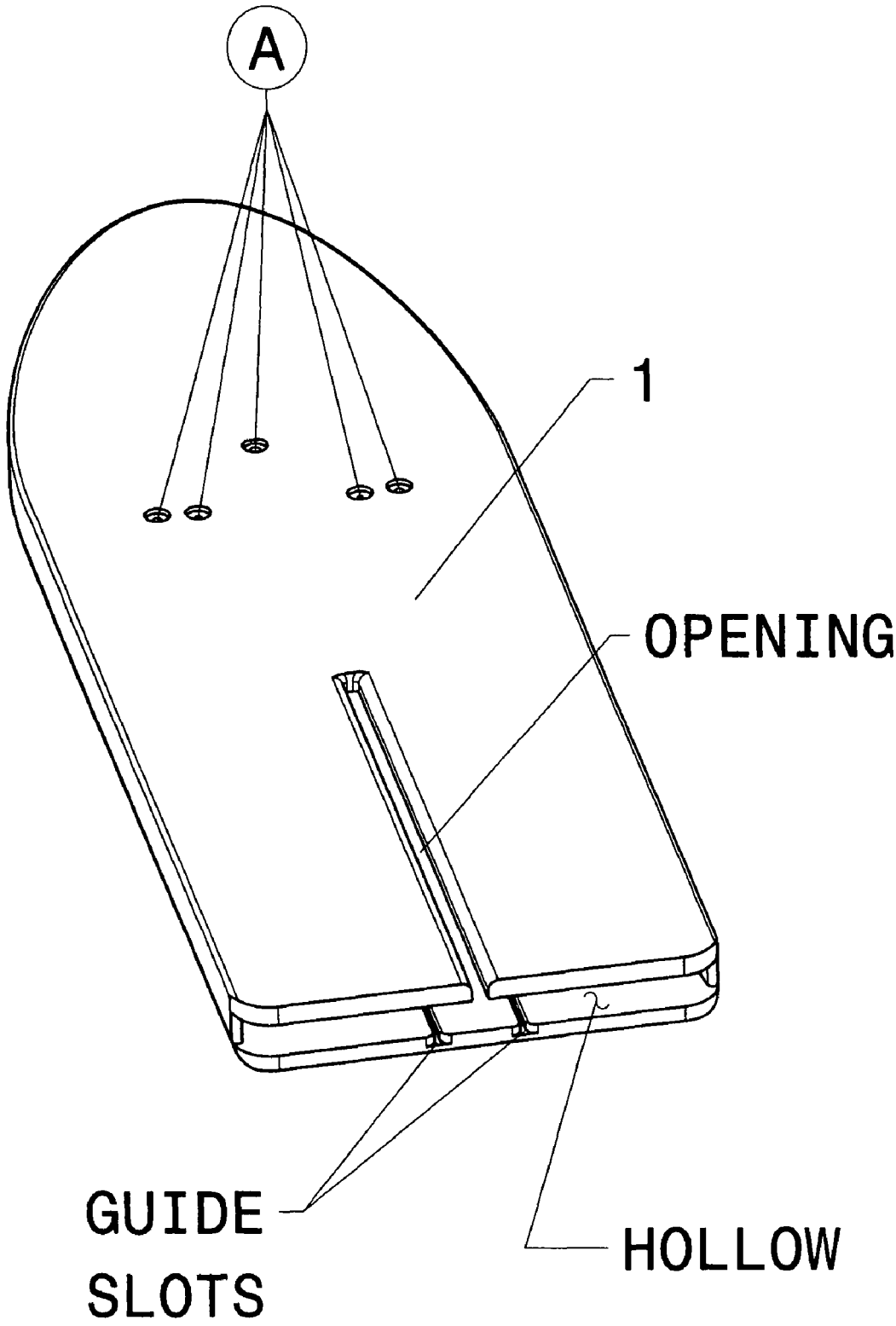

FIG. 14B shows the surfboard of FIG. 14A without showing hidden lines.

Figure 15:
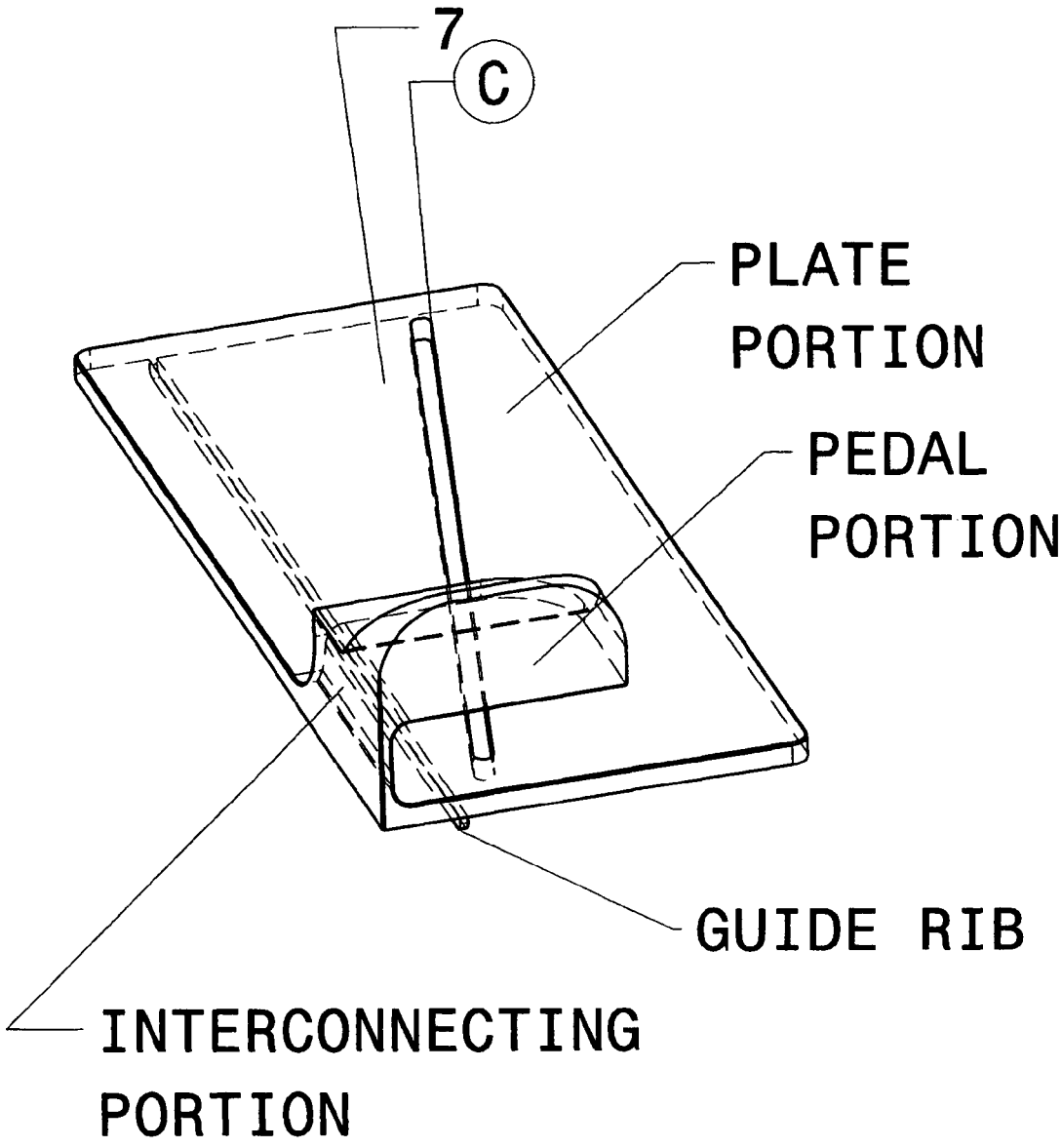

FIG. 15 shows a cam plate with plate portion, pedal portion and interconnecting portion and also a cam slot and guide rib.

Figure 16A:
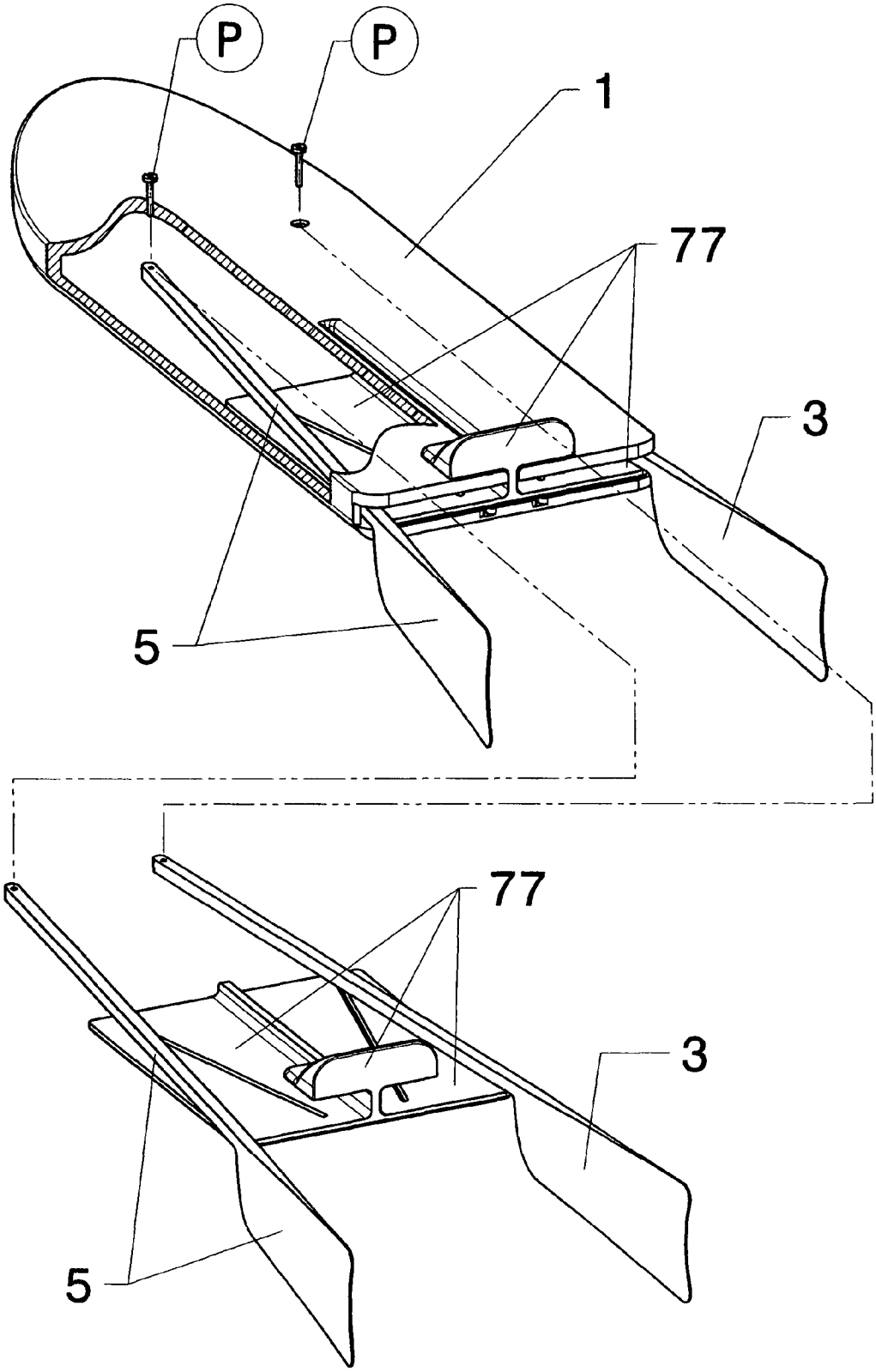

FIG. 16A shows an isometric exploded view of a watercraft of the invention with two fin bars and a single cam plate, the cam plate having two cam means.

Figure 16B:
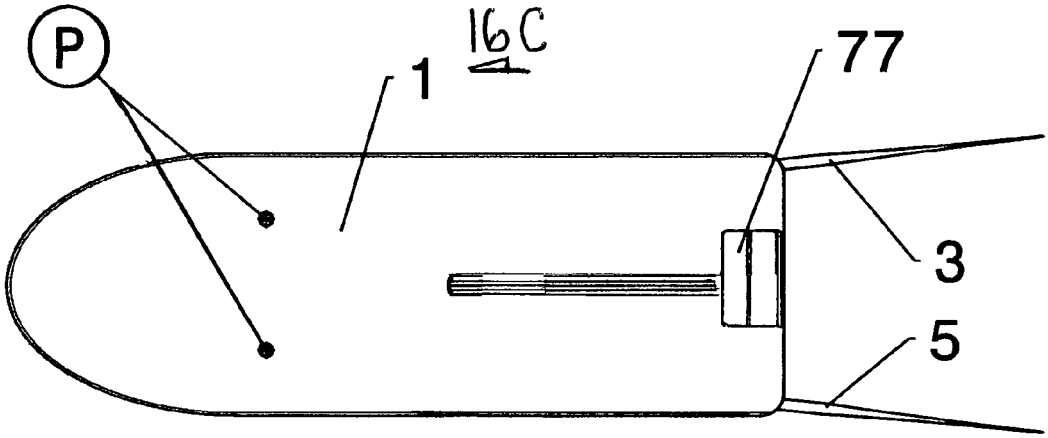

FIG. 16B shows a top view of the craft of FIG. 16A and the position of section 16C.

Figure 16C:
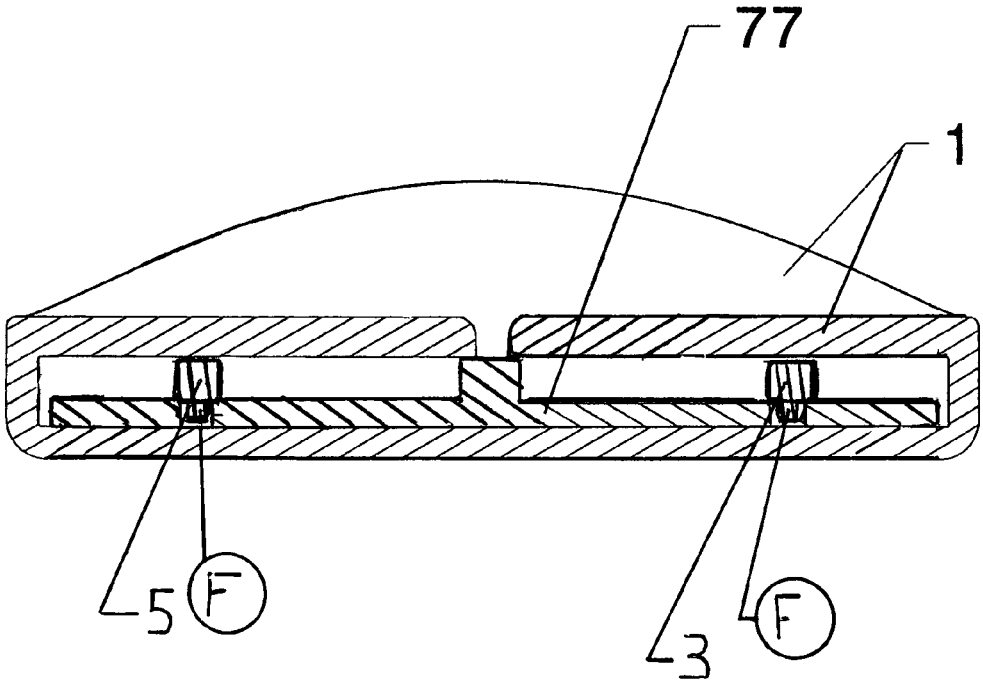

FIG. 16C is a section view of the craft of FIGS. 16A and 16B to show the relation of the cam followers of the fin bars to the single cam plate.

Figure 17:
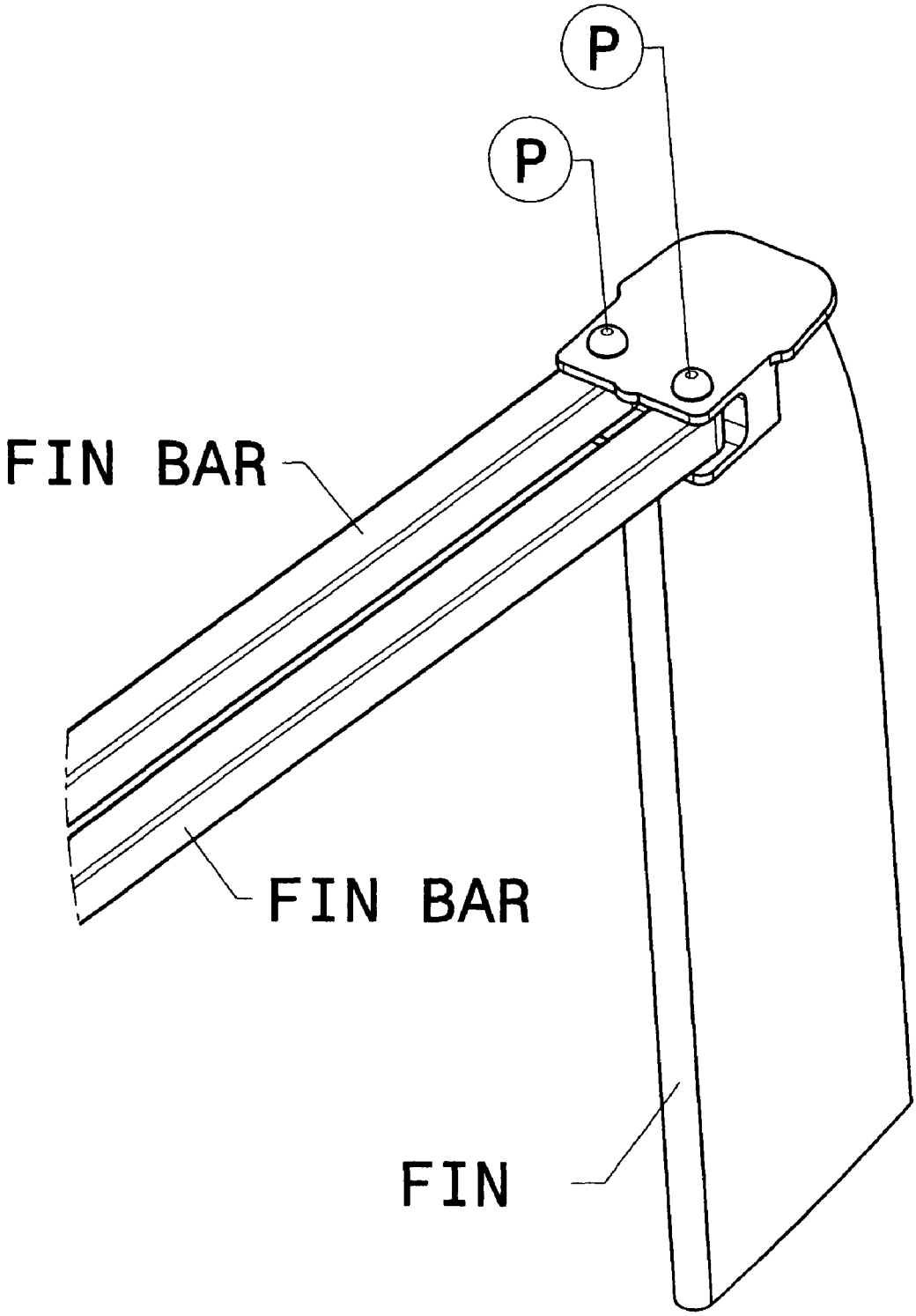

FIG. 17 shows an isometric view of a fin pivoted to two parallel fin bars.

Figure 18A:
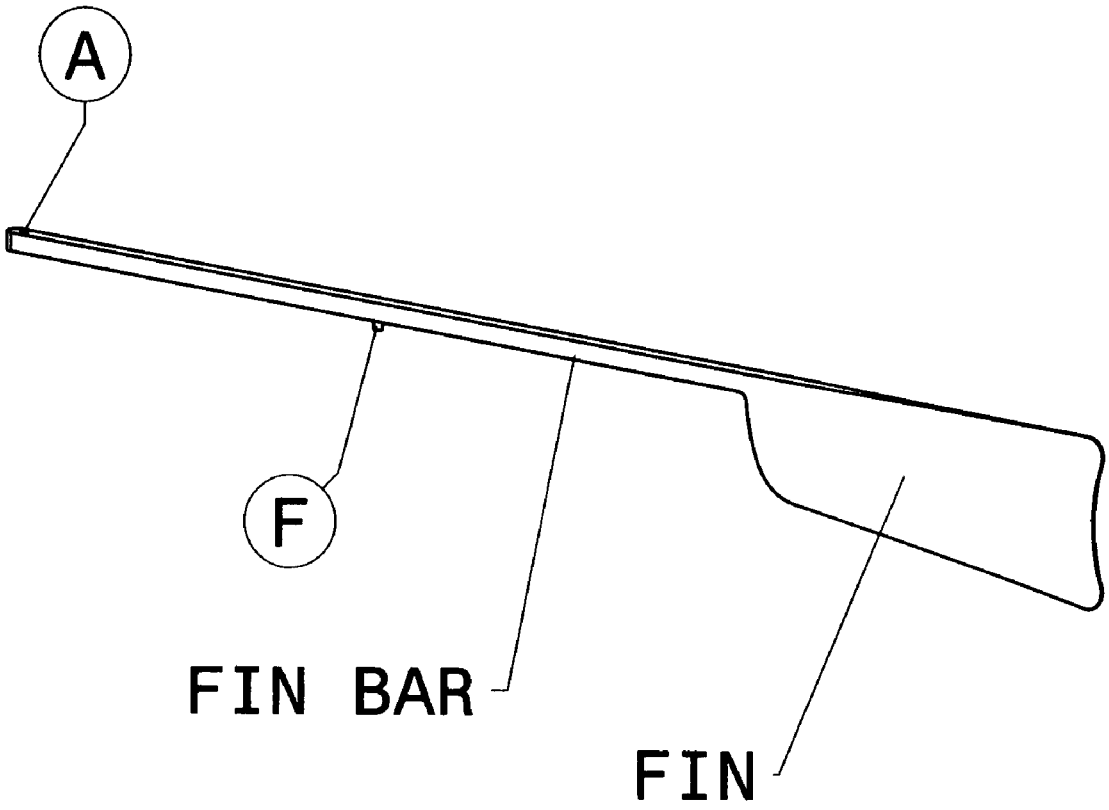

FIG. 18A shows an isometric view of a fin bar having an integral fin at the aft end, and having an aperture at the forward end, and a cam follower on a portion of the fin bar.

Figure 18B:
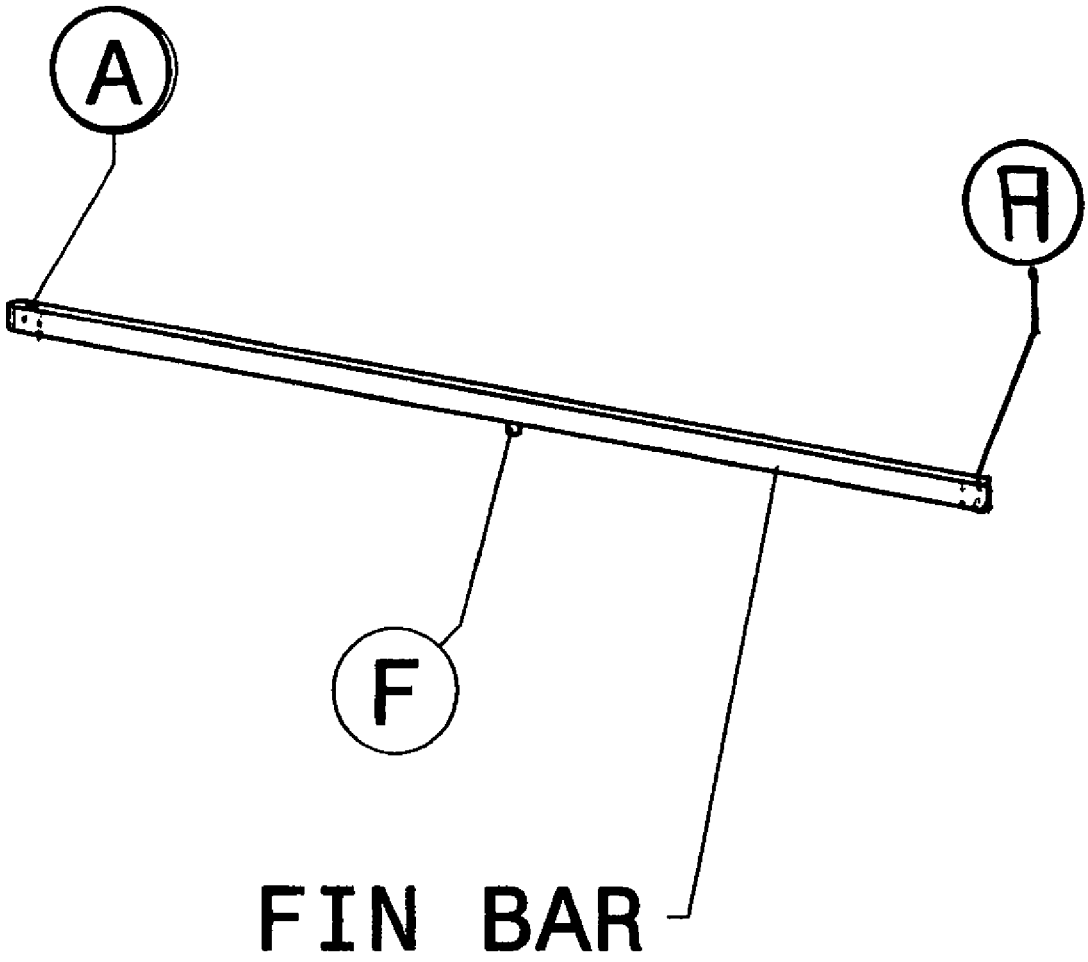

FIG. 18B shows an isometric view of a fin bar having an aperture at the forward end and another aperture at the aft end, and a cam follower on a portion of the fin bar.

Figure 19:
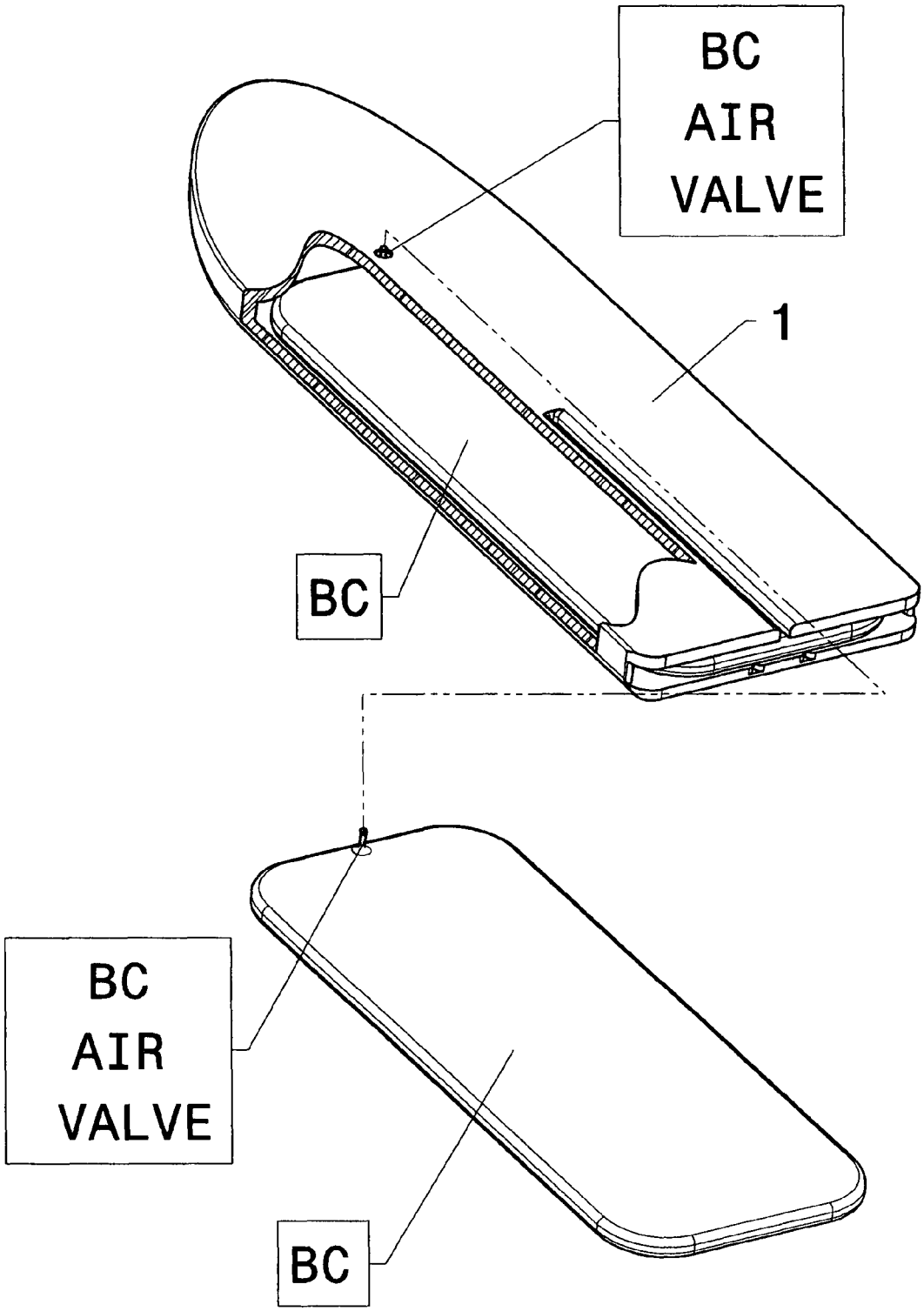

FIG. 19 shows an isometric exploded partial section view of a hollow surfboard with a buoyancy compensator installed in the hollow of the surfboard and the buoyancy compensator having an air valve protruding thru an aperture of the surfboard.

Figure 20:
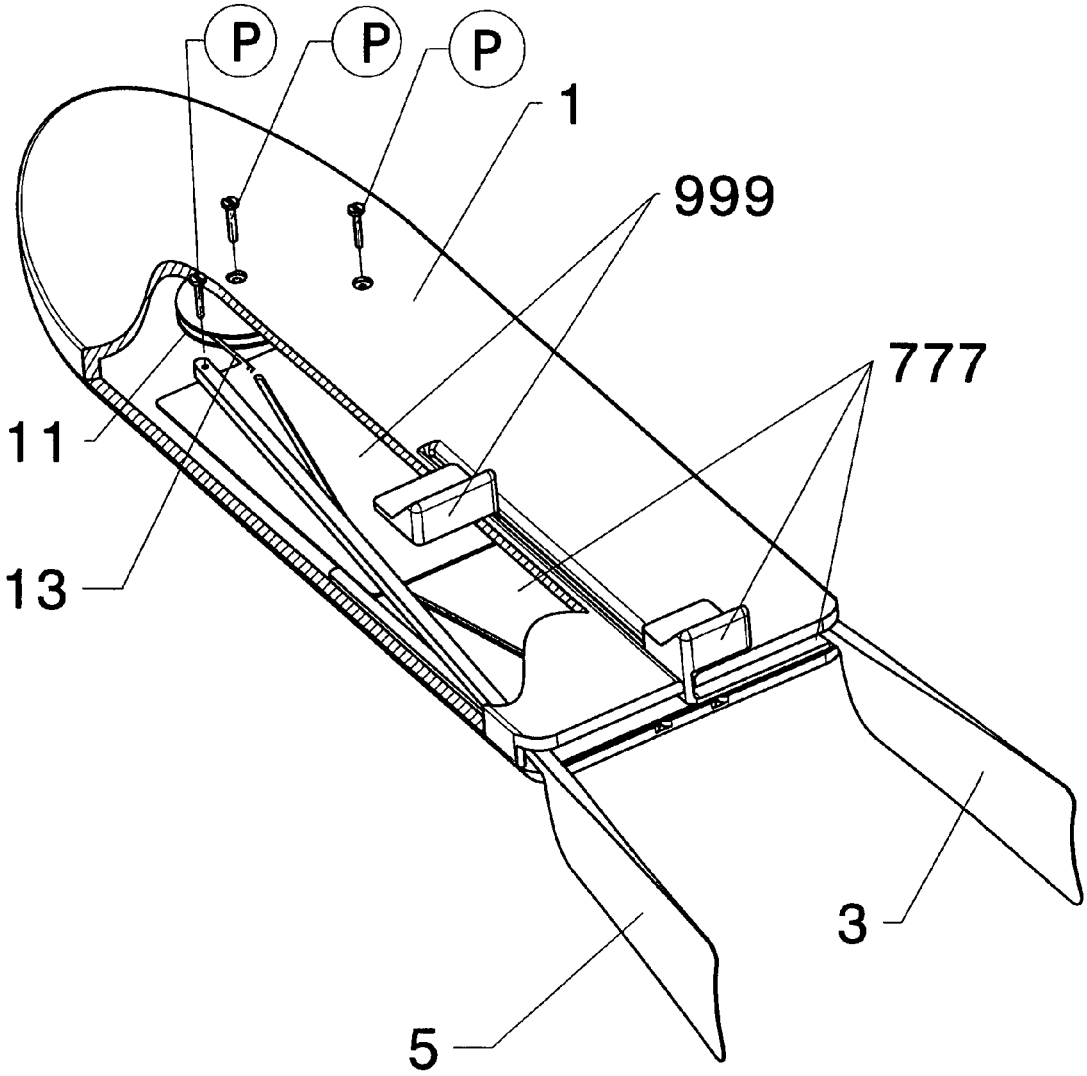

FIG. 20 shows an isometric partial section view of a watercraft of the invention having a lower pedaled cam plate and an upper pedaled cam plate, two fin bars having fins, a pulley and belt, the watercraft body, and pivot attachments.

Figure 21:
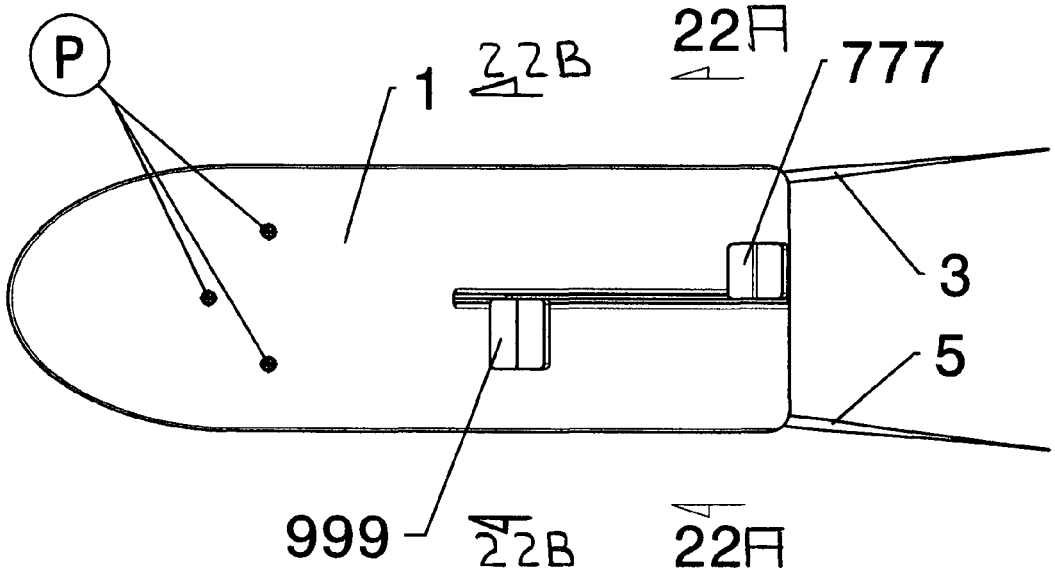

FIG. 21 shows a top view of the watercraft of FIG. 20 and the positions of sections 22A and 22B.

Figure 22A:
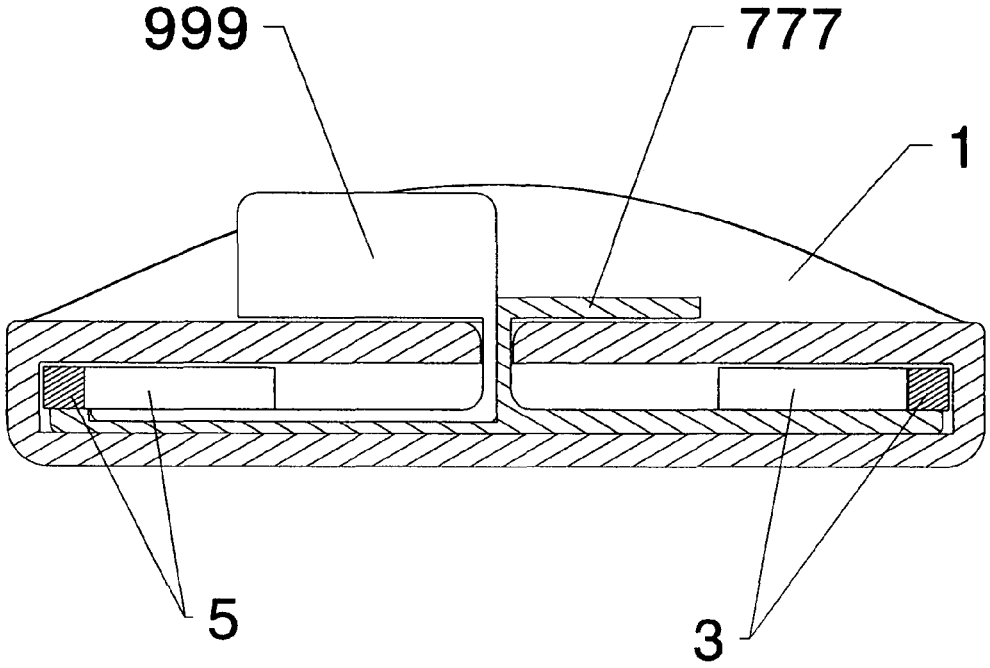

FIG. 22A is a section view of the craft of FIGS. 20 and 21 showing that the upper pedaled cam plate rides upon the lower pedaled cam plate, and the fin bars.

Figure 22B:
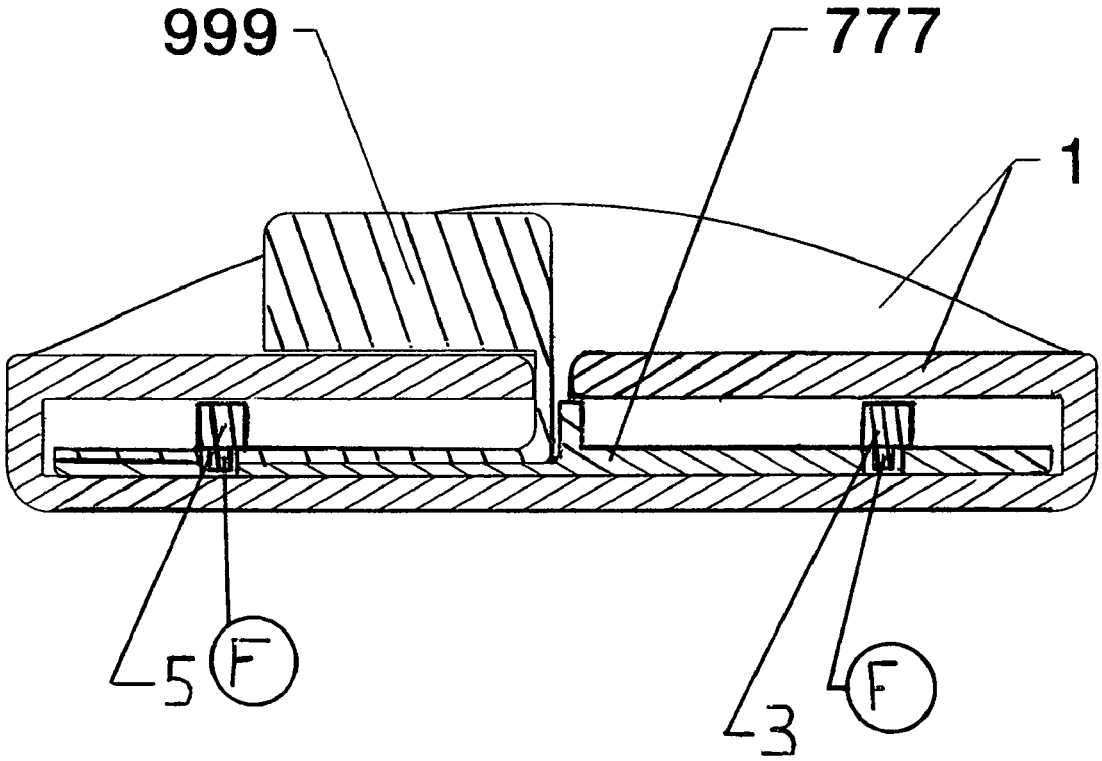

FIG. 22B is a section cut of the craft of FIGS. 20, 21, and 22A to show the relation of the cam followers of the fin bars to the upper and lower cam plates.

DRAWINGS

Reference Numerals, Terms (Equivalents), Symbols

1 hollow surfboard (skim board/body board/boogie board/kneeboard) with the hollow open to the sea
3 fin bar with integral fin, right side
5 fin bar with integral fin, left side
7 cam plate with pedal, right side
9 cam plate with pedal, left side
11 pulley (sprocket)
13 belt (cable/chain/line/rope)
77 cam plate with one central pedal for both feet and two cams
103 fin bar with pivot engaging apertures at opposing ends, right side
105 fin bar with pivot engaging apertures at opposing ends, left side
107 pivotal fin, right side
109 pivotal fin, left side
203 fin bar with pivot engaging apertures at opposing ends; one element of the four bar fin movement made up of 1, 203, 205, and 211.
205 fin bar with pivot engaging apertures at opposing ends; one element of the four bar fin movement made up of 1, 203, 205, and 211.
207 fin bar with pivot engaging apertures at opposing ends; one element of the four bar fin movement made up of 1, 207, 209, and 213.
209 fin bar with pivot engaging apertures at opposing ends; one element of the four bar fin movement made up of 1, 207, 209, and 213.
211 fin with dual pivots, one element of the four bar fin movement made up of 1, 203, 205, and 211.
213 fin with dual pivots, one element of the four bar fin movement made up of 1, 207, 209, and 213.
777 lower right pedaled cam plate with at least one cam.
999 upper pedaled cam plate with one cam.
The letter "A" encircled indicates an aperture.
The letter "C" encircled indicates a cam.
The letter "F" encircled indicates a cam follower.
The letter "P" encircled indicates a fastener, pin, or pivot.
The letters "BC" in a circumscribing square indicate a buoyancy compensator.
The phrase "BC Air Valve" in a circumscribing square indicates an air valve of a buoyancy compensator device.

DETAIL DESCRIPTION OF THE INVENTION

The invention will now be described more fully hereinafter with reference to the accompanying drawings in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
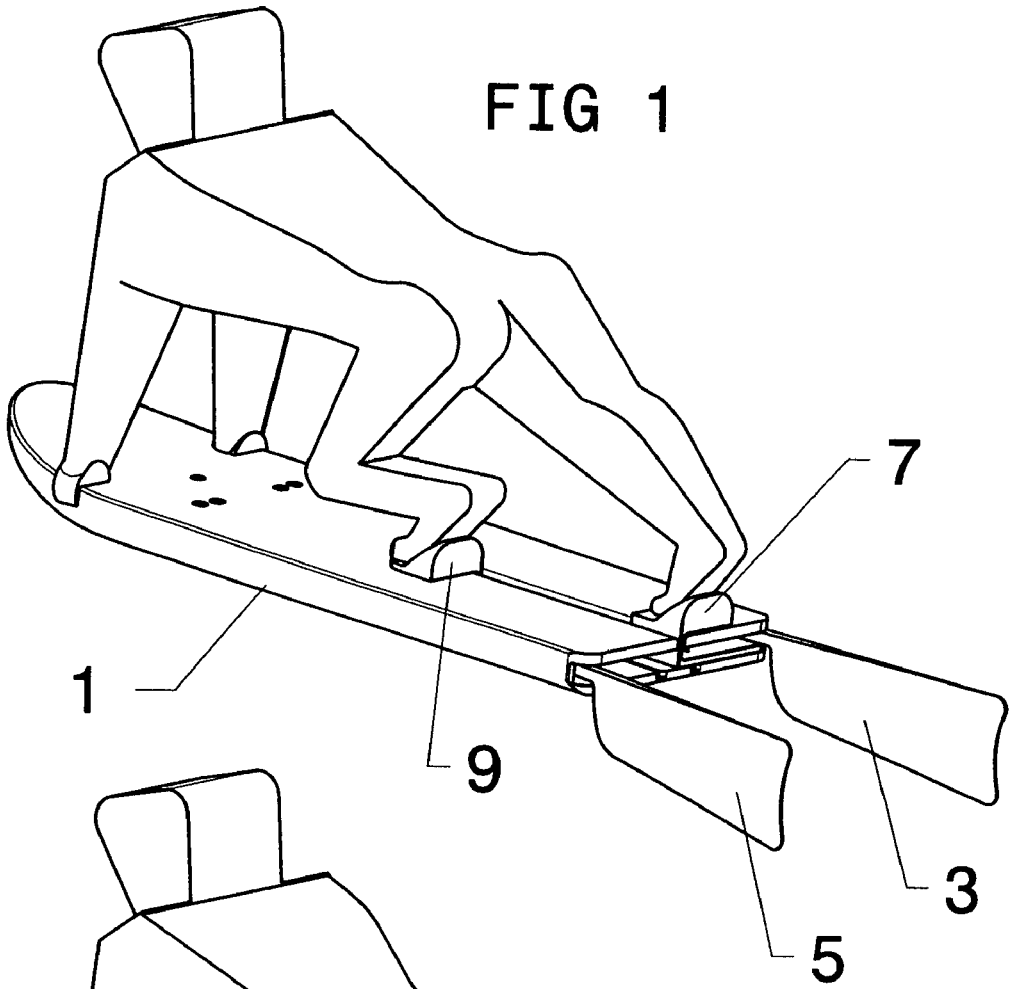

FIG. 1 shows a watercraft and rider, the craft made up of a hollow body 1, a set of fin bars 3 and 5 having vertical fins projecting from the aft portion of the hollow of 1, and a set of foot engaging cam plates 7 and 9. The user has thrust the right leg back upon cam plate 7, causing the fins to open.

Figure 2:
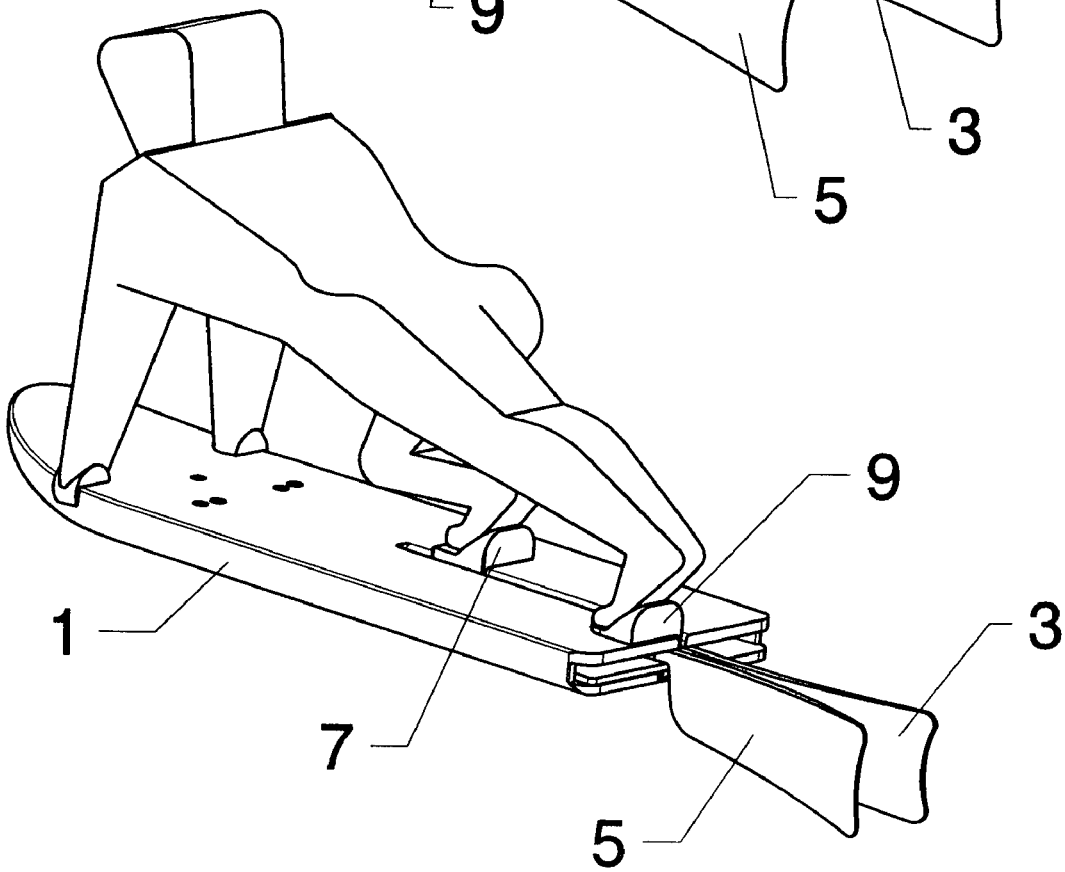

FIG. 2 shows the watercraft of FIG. 1, the user now having thrust the left leg back causing the fin bars 3 and 5 to close to the center portion of the craft; the fins of fin bars 3 and 5 are shown deflected as though under load.

Figure 3:
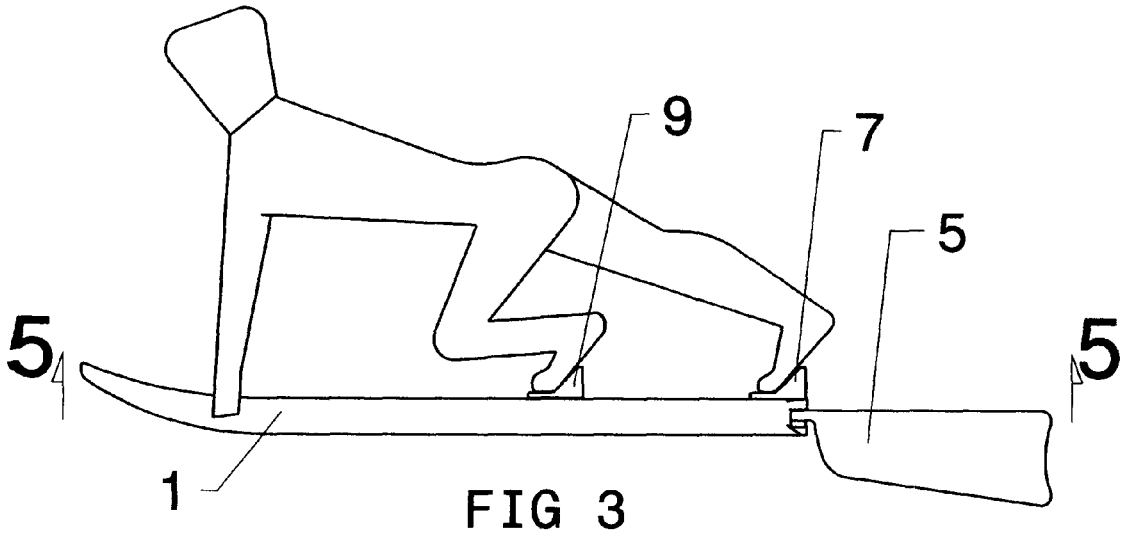

FIG. 3 shows a side view of the craft of FIGS. 1 and 2.

Figure 4:
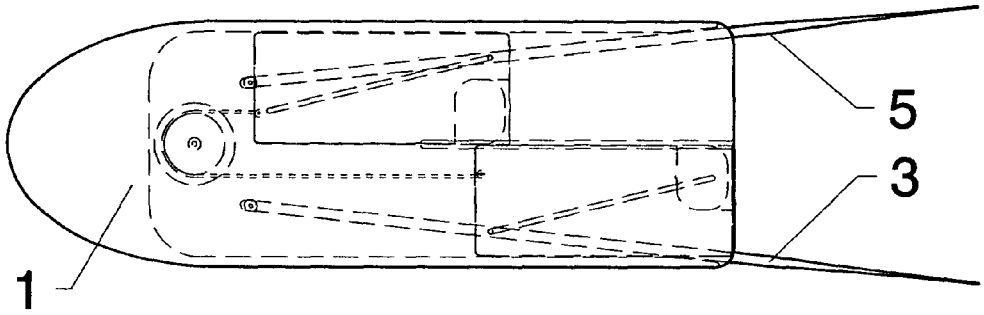
FIG. 4 shows a bottom view of the watercraft of the invention.

FIG. 4 shows a bottom view of the craft of FIGS. 1, 2, and 3 where the fins of fin bars 3 and 5 are shown in an open position.

Figure 5:
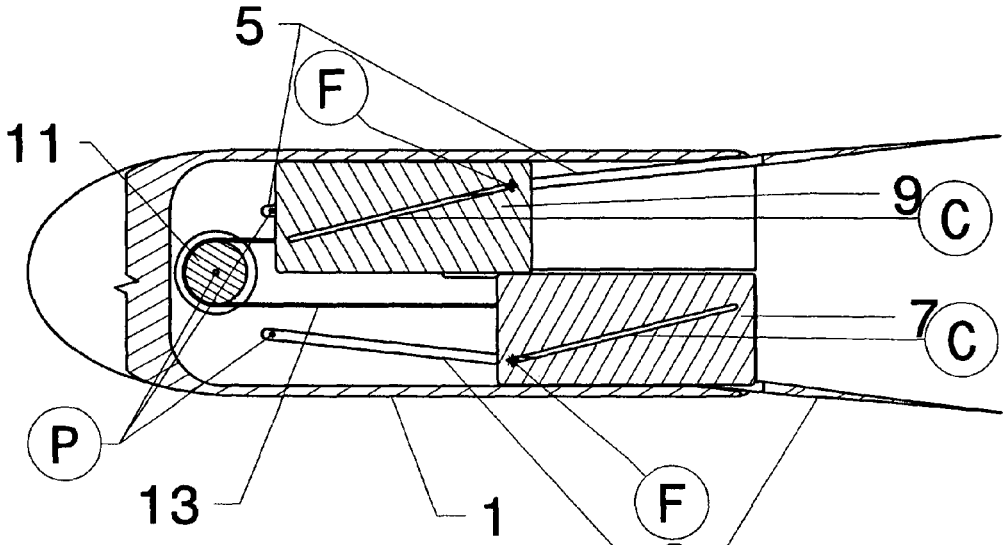
FIG. 5 shows a section cut view from the bottom perspective of the watercraft of the invention.

FIG. 5 shows the craft of FIGS. 1, 2, 3, and 4 in a bottom view section cut thru the mid level of the craft body 1. The body 1 has a substantial hollow portion going from a forward portion of the body and the hollow opens at an aft portion of the body. Fin bars 3 and 5 are pivotally attached at forward ends to the forward portion of the craft thru deck apertures connecting the hollow and the deck. Fin bars 3 and 5 have cam followers 3F and 5F in fin bar portions and engage cam plates 7 and 9 at cams 7C and 9C. Cam plates 7 and 9 are interconnected via belt 13 and pulley 11, pulley 11 being attached to body 1 by an attachment pivot.

Figure 6A:
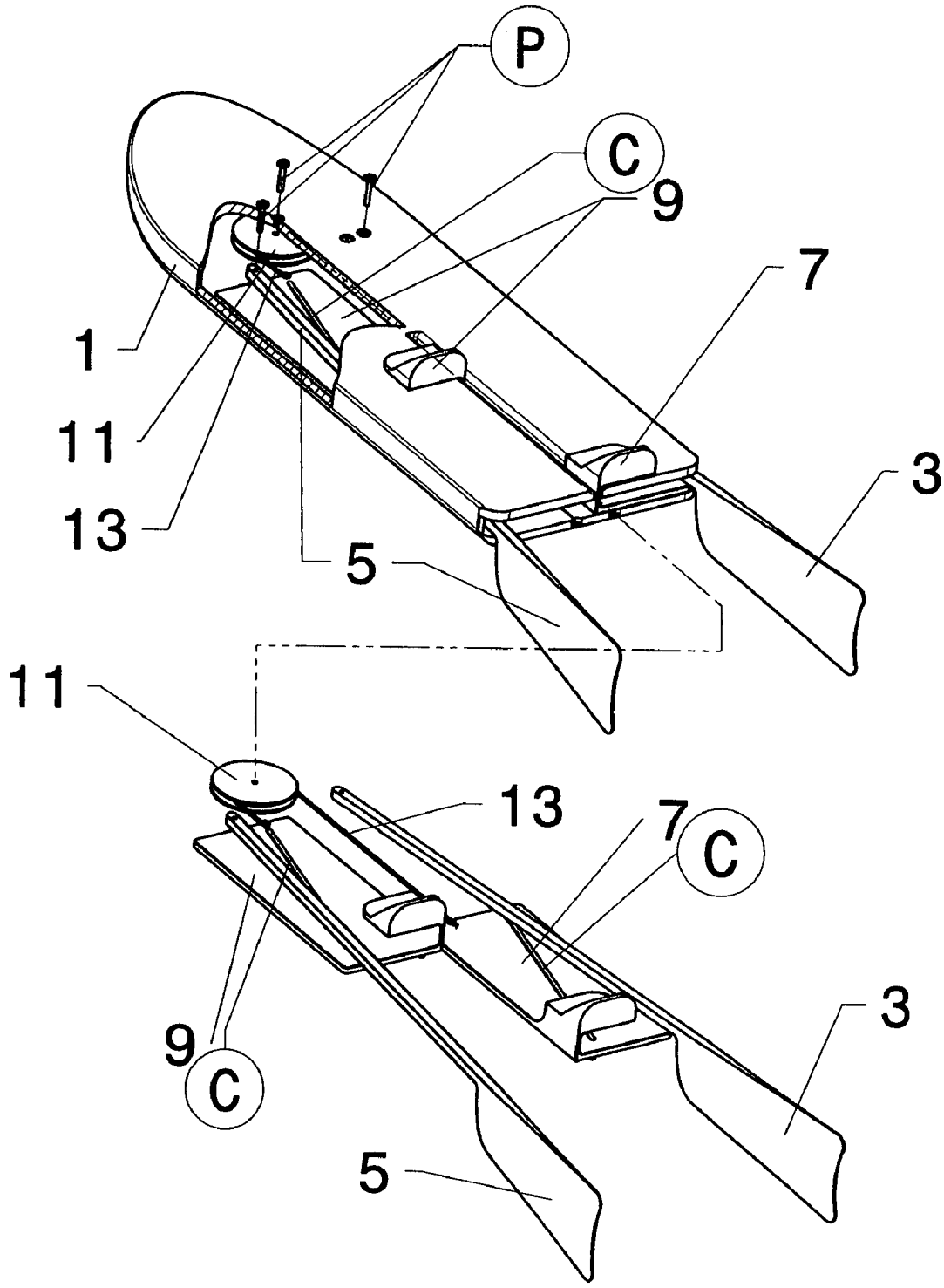
FIG. 6A shows an isometric exploded view of the watercraft of the invention with two integral fin bars and fins.

FIG. 6A shows an exploded isometric view of the watercraft of the invention comprised of the craft body 1 having a large hollow, and a plurality of pivot engaging apertures connecting the deck to the hollow. The apertures receive pivots (P) and the pivots engage fin bars 3 and 5 at pivot engaging apertures in forward fin bar portions. The fin bars 3 and 5 each have a fin coupled to aft fin bar portions. Fin bars 3 and 5 further have cam followers at portions of the fin bars. The cam followers engage with the cams of cam plates 7 and 9. The cam plates 7 and 9 have foot engaging means projecting above the deck of the craft and cam in plate portions and also interconnecting portions. The plate portions of the cam plates slidingly engage a lower hollow surface of the craft. Cam plates 7 and 9 are operationally interconnected via belt 13 and pulley 11 where one end of belt 13 is connected to cam plate 7 and an opposite end of belt 13 is connected to cam plate 9 and a portion of belt 13 wraps around pulley 11 so that as a user thrusts one pedal of a cam plate aft, the other cam plate translates forward and the fin bars sweep open or closed. The hollow of the craft allows the sea to enter the hollow and serve as a fluid lubricant for the various sliding parts.

Figure 6B:
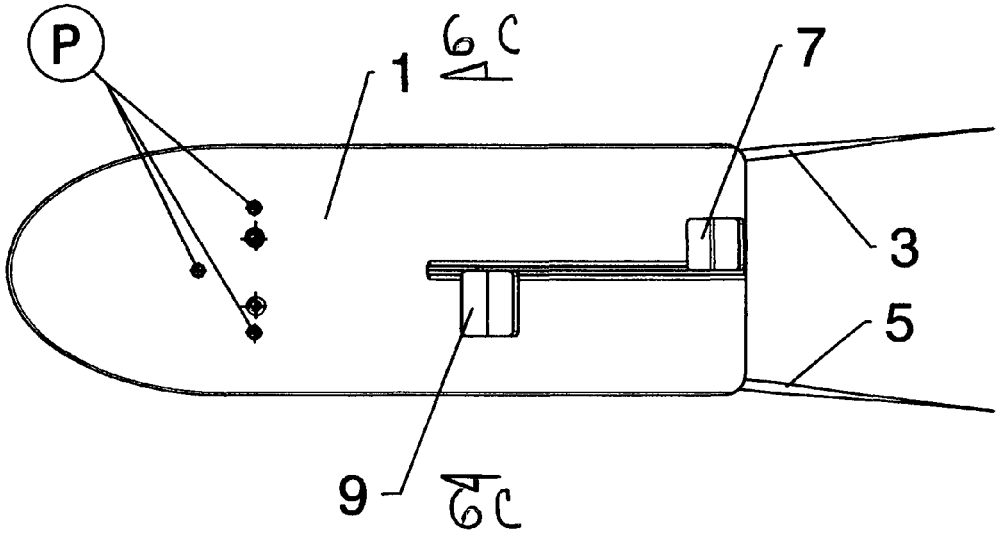
FIG. 6B shows a top view of the craft of FIG. 6A and the position of section 6C.

FIG. 6B top view of the device of FIG. 6A shows elements 1, 3, 5, 7, 9, and the pivots.

Figure 6C:
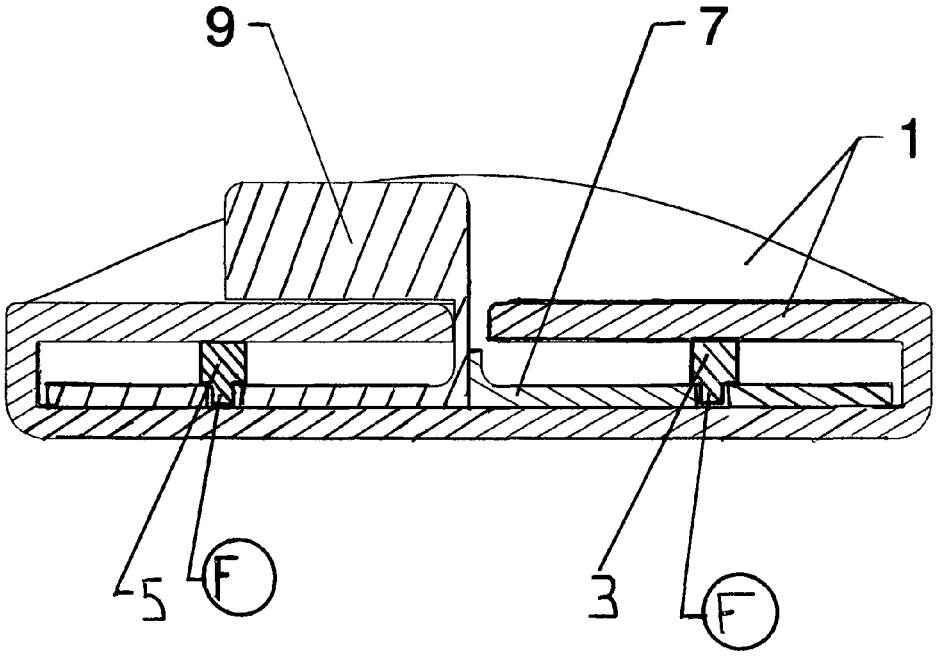
FIG. 6C is a section view of the craft of FIGS. 6A and 6B to show the relation of the cam followers of the fin bars to the cam plates.

FIG. 6C section of the device of FIGS. 6A and 6B shows the craft 1, fin bars 3 and 5 with their cam followers and the cam followers protruding into the cam slot of respective cam plates 7 and 9.

Figure 7A:
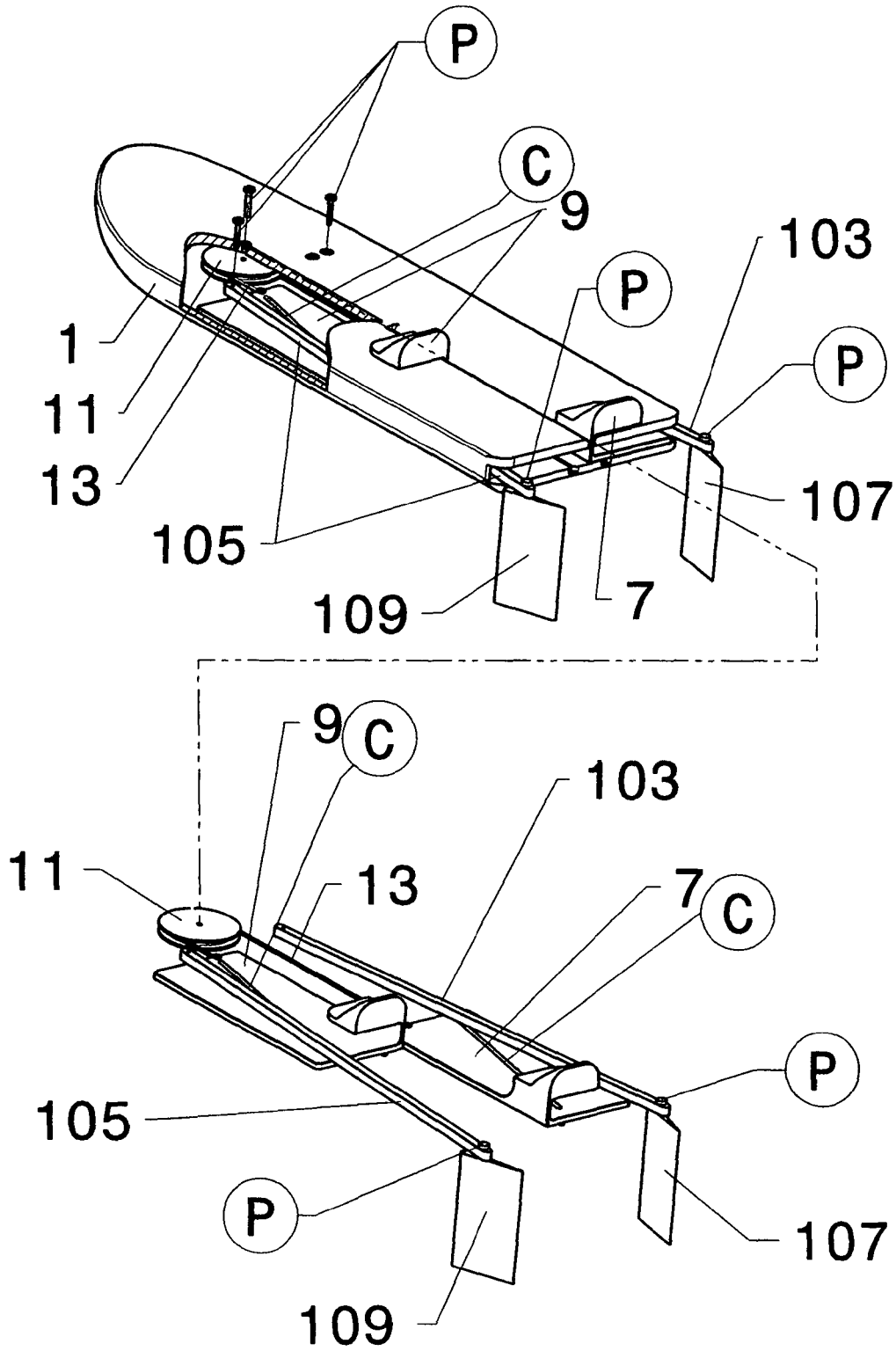
FIG. 7A shows an isometric exploded view of the watercraft of the invention with two pivotal fins attached to fin bars.

FIG. 7A shows an exploded isometric view of the watercraft of the invention comprised of the craft body 1 having a large hollow, and a plurality of pivot engaging apertures connecting the deck to the hollow. The apertures receive pivots (P) and the pivots engage fin bars 103 and 105 at pivot engaging apertures in forward fin bar portions. The fin bars 103 and 105 each respectively have a fin 107 and 109 pivotally coupled to aft fin bar portions of fin bar 103 and 105. Fin bars 103 and 105 further have cam followers at portions of the fin bars. The cam followers engage with the cams of cam plates 7 and 9. The cam plates 7 and 9 have foot engaging means projecting above the deck of the craft and each cam plate has a cam in the plate portion and each cam plate also has interconnecting portions which interconnect the foot engaging means to the plate portions. The plate portions of cam plates 7 and 9 slidingly engage a lower surface of the craft. Cam plates 7 and 9 are operationally interconnected via belt 13 and pulley 11 where one end of belt 13 is connected to cam plate 7 and an opposite end of belt 13 is connected to cam plate 9 and a portion of belt 13 wraps around pulley 11 so that as a user thrusts one pedal of a cam plate aft, the other cam plate translates forward and the fin bars sweep open or closed. Further, the pivot coupling the two components, fin bar 103 and fin 107 is located forward of a mid-portion of the fin 107. Likewise, fin bar 105 is pivotally connected to fin 109 thru an aperture at the aft portion of fin bar 105 and the aperture in the fin 109 is again forward of the fin 109 mean chord line. The hollow of the craft allows the sea to enter the hollow and serve as a fluid lubricant for the various sliding parts.

Figure 7B:
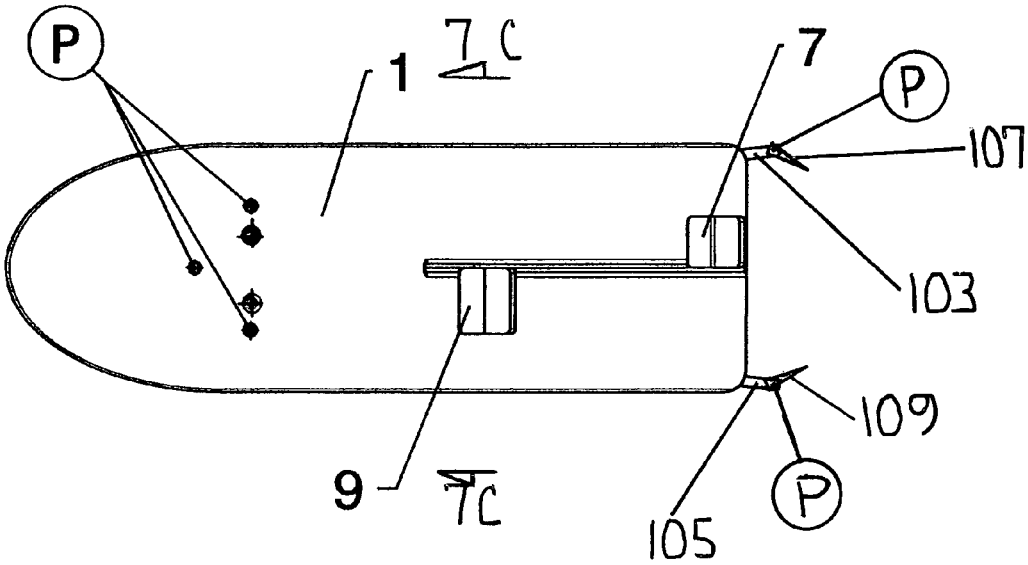
FIG. 7B shows a top view of the craft of FIG. 7A and the position of section 7C.

FIG. 7B top view of the device of FIG. 7A shows elements 1, 103, 105, 107, 109, 7, 9, and the pivots.

Figure 7C:
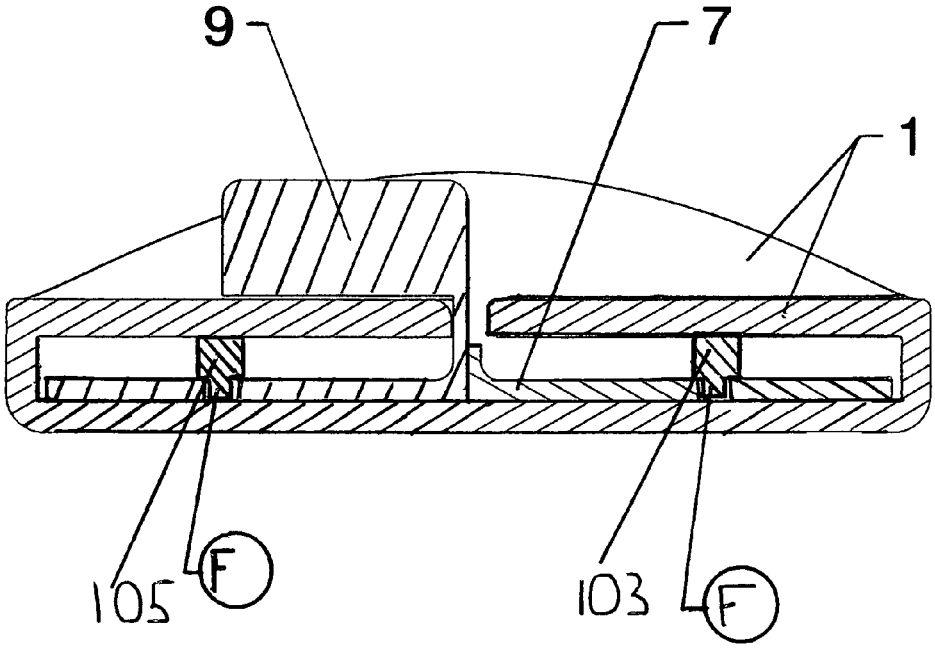
FIG. 7C is a section view of the craft of FIGS. 7A and 7B to show the relation of the cam followers of the fin bars to the cam plates.

FIG. 7C section of the device of FIGS. 7A and 7B shows the craft body 1, fin bars 103 and 105 with their cam followers and the cam followers protruding into the cam slot of respective cam plates 7 and 9.

Figure 8A:
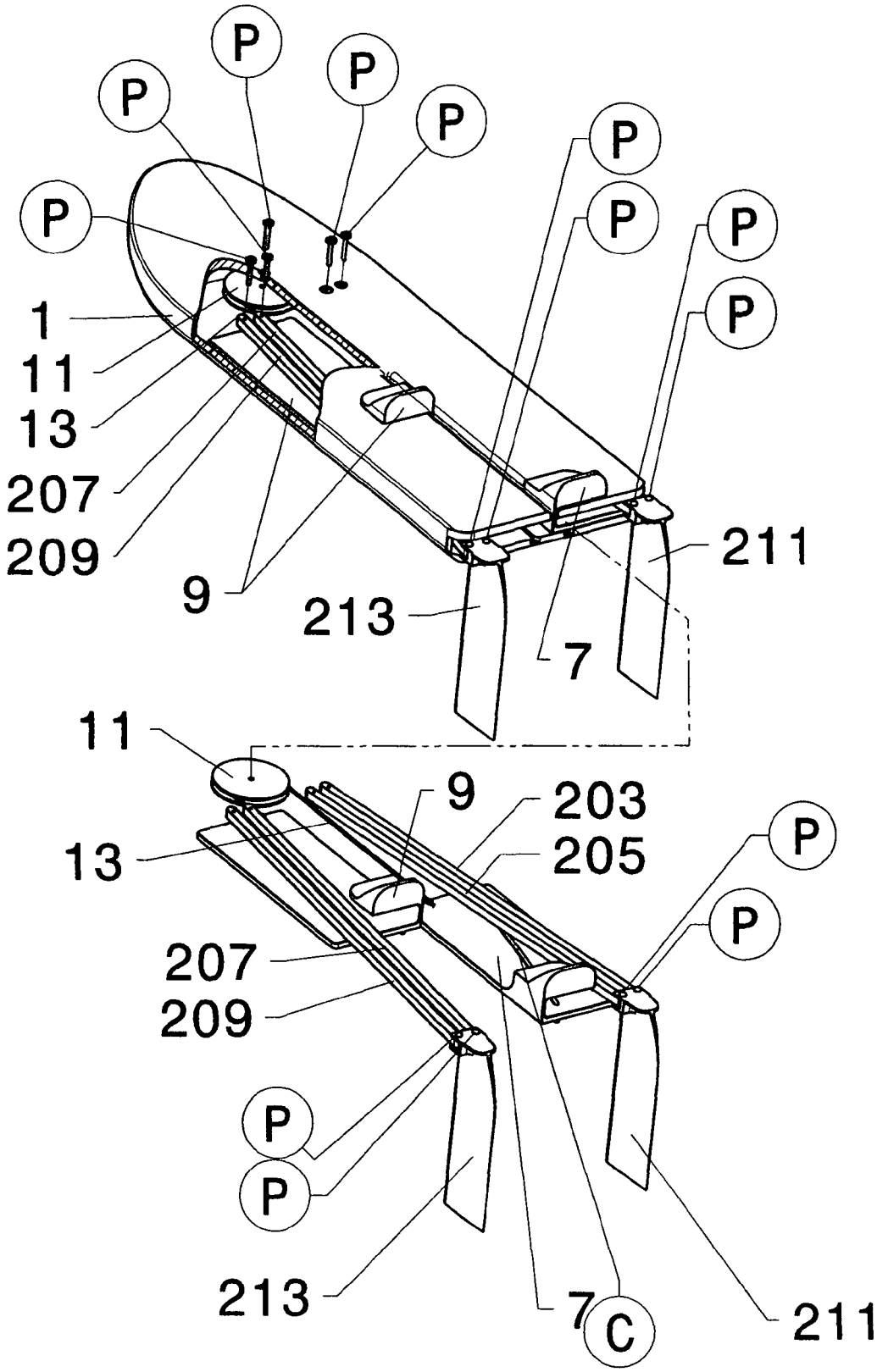
FIG. 8A shows an isometric exploded view of the watercraft of the invention with two four bar fin movements.

FIG. 8A shows an exploded isometric view of the watercraft of the invention comprised of the craft body 1 having a large hollow, the hollow being open to the sea at the aft end of the body, and a plurality of pivot engaging apertures connecting the deck to the hollow. The apertures receive pivots (P) and the pivots engage fin bars 203, 205, 207, and 209 at pivot engaging apertures in forward fin bar portions. The fin bars 203 and 205 have pivot engaging apertures in aft fin bar portions and engage fin 211 at two apertures. Fin bars 203 and 205 further have cam followers at portions of the fin bars. The cam followers engage with the cam of cam plate 7. The cam plates 7 and 9 have foot engaging means projecting above the deck of the craft and each has a cam in the plate portion of the cam plate, and each also has an interconnecting portion which connects the plate portion to the foot engaging means. The plate portions of cam plates 7 and 9 slidingly engage a lower surface of the craft 1. Fin bars 207 and 209 have pivot engaging apertures in aft fin bar portions and engage fin 213 at two fin apertures. Fin bars 207 and 209 further have cam followers at portions of the fin bars. The cam followers of the fin bars 207 and 209 engage the cam of cam plate 9. Cam plates 7 and 9 are operationally interconnected via belt 13 and pulley 11, pulley 11 being rotatably connected to the craft body 1 thru an aperture common to body 1 and pulley 11, and where one end of belt 13 is connected to cam plate 7 and an opposite end of belt 13 is connected to cam plate 9 and a portion of belt 13 wraps around pulley 11, so that as a user thrusts one pedal of a cam plate aft, the other cam plate translates forward and the fin bars sweep open or closed. The hollow of the craft allows the sea to enter the hollow and serve as a fluid lubricant for the various sliding parts.

Figure 8B:
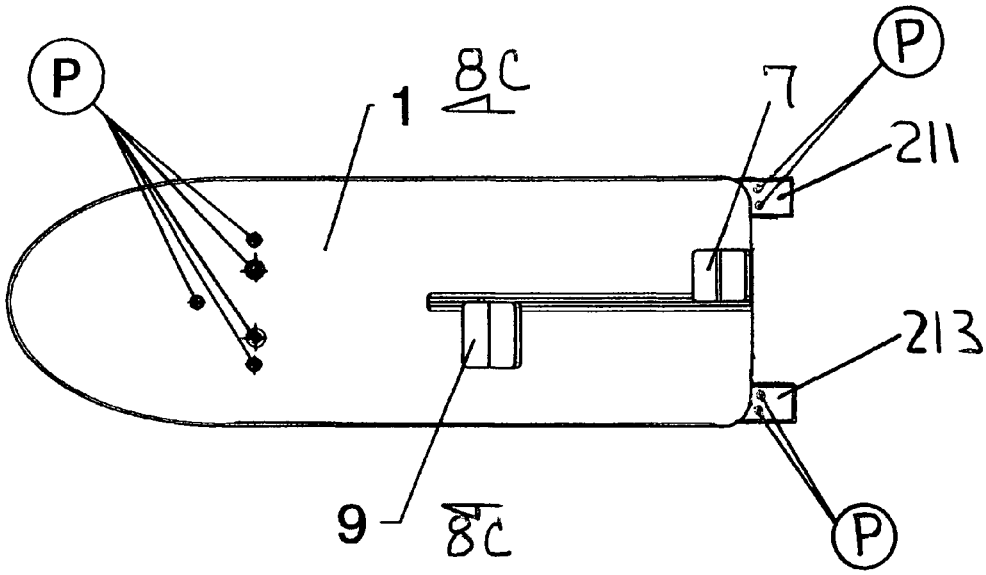
FIG. 8B shows a top view of the craft of FIG. 8A and the position of section 8C.

FIG. 8B top view of the device of FIG. 8A shows elements 1, 7, 9, 211, 213, and the pivots.

Figure 8C:
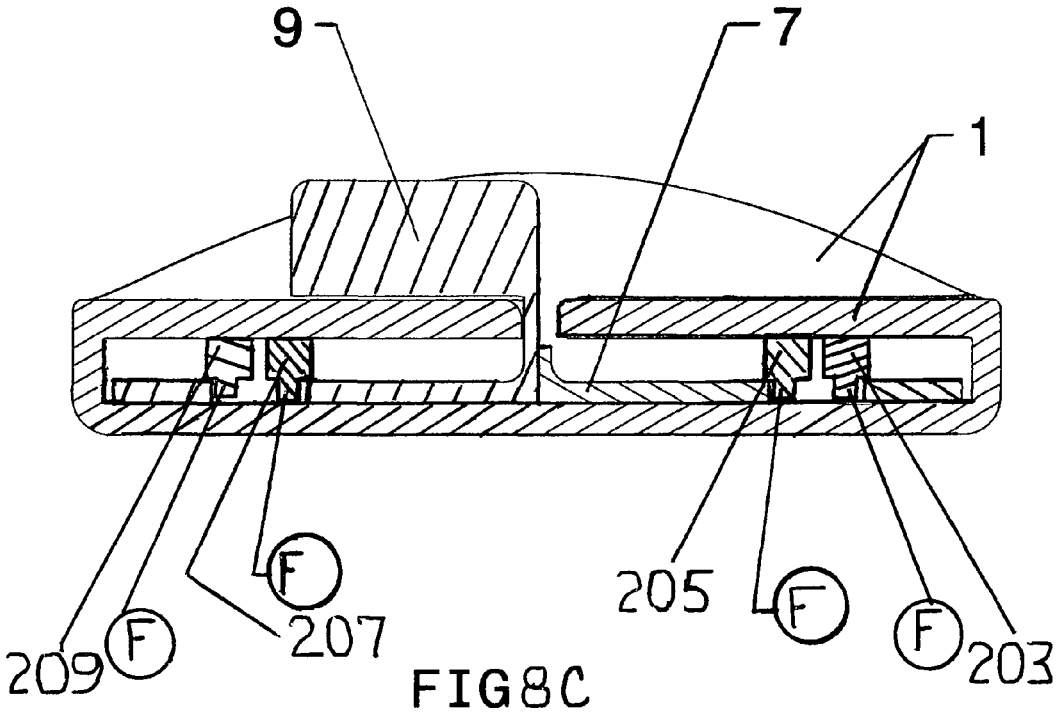
FIG. 8C is a section view of the craft of FIGS. 8A and 8B to show the relation of the cam followers of the fin bars to the cam plates.

FIG. 8C section of the device of FIGS. 8A and 8B shows craft body 1, fin bars 203, 205, 207, 209 and their respective cam followers, the cam followers protruding into the cam slots of respective cam plates 7 and 9.

Figure 9:
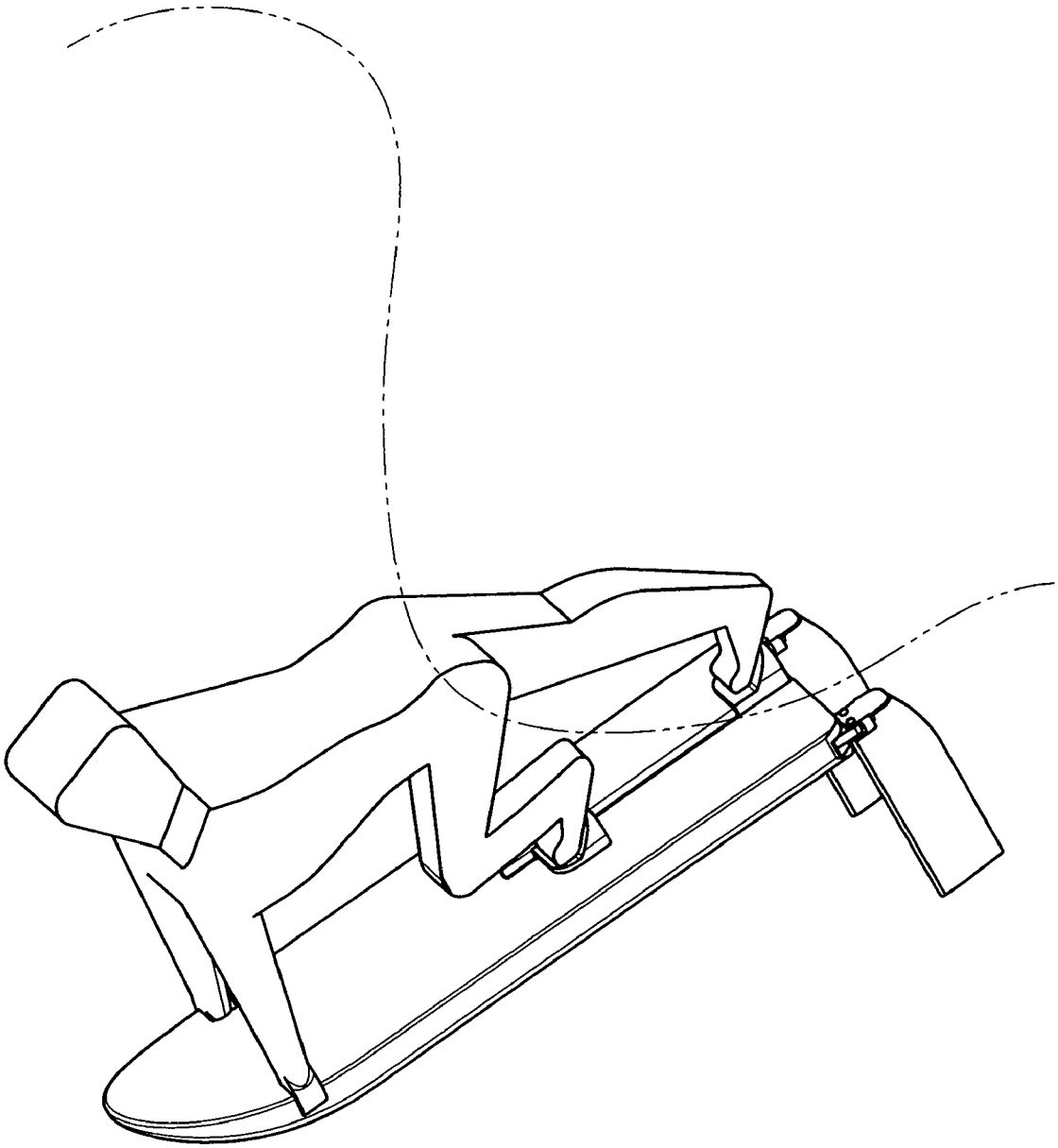
FIG. 9 shows a surfer diving the watercraft of the invention beneath an oncoming wave.

FIG. 9 shows a user diving the watercraft of the invention below an oncoming ocean wave; this is accomplished by an activating forward movement of the user's center of gravity, thereby weighting the forward craft portion more than the aft craft portion, and declining the forward portion below the sea surface and continuing to pedal and thrust the foot engaging means of the craft to thereby dive and propel the craft from the sea surface to a depth of the sea.

Figure 10:
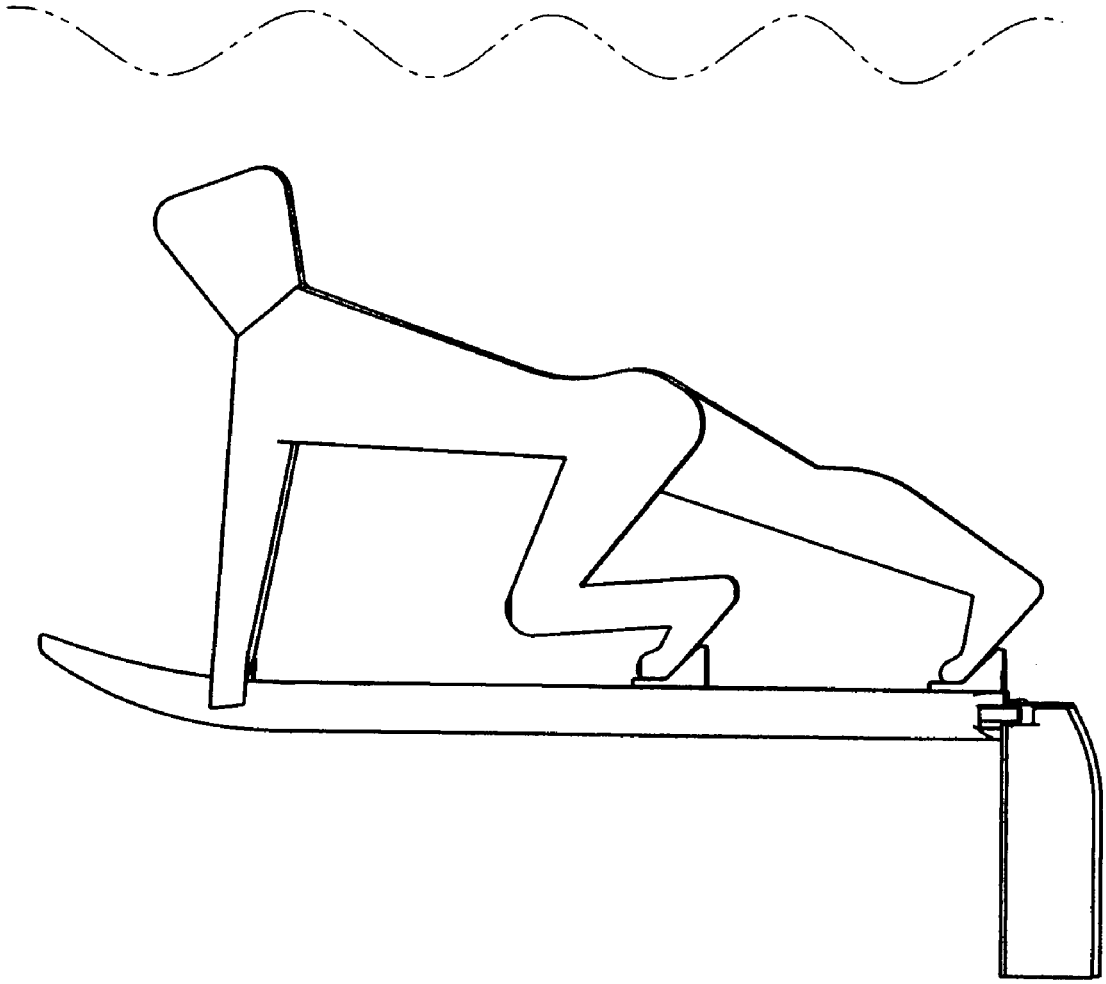
FIG. 10 shows a user propelling the watercraft of the invention at a depth beneath the surface of the sea.

FIG. 10 shows a user operating the watercraft of the invention at a depth beneath the agitated surface of the sea in a straight and level orientation.

Figure 11:
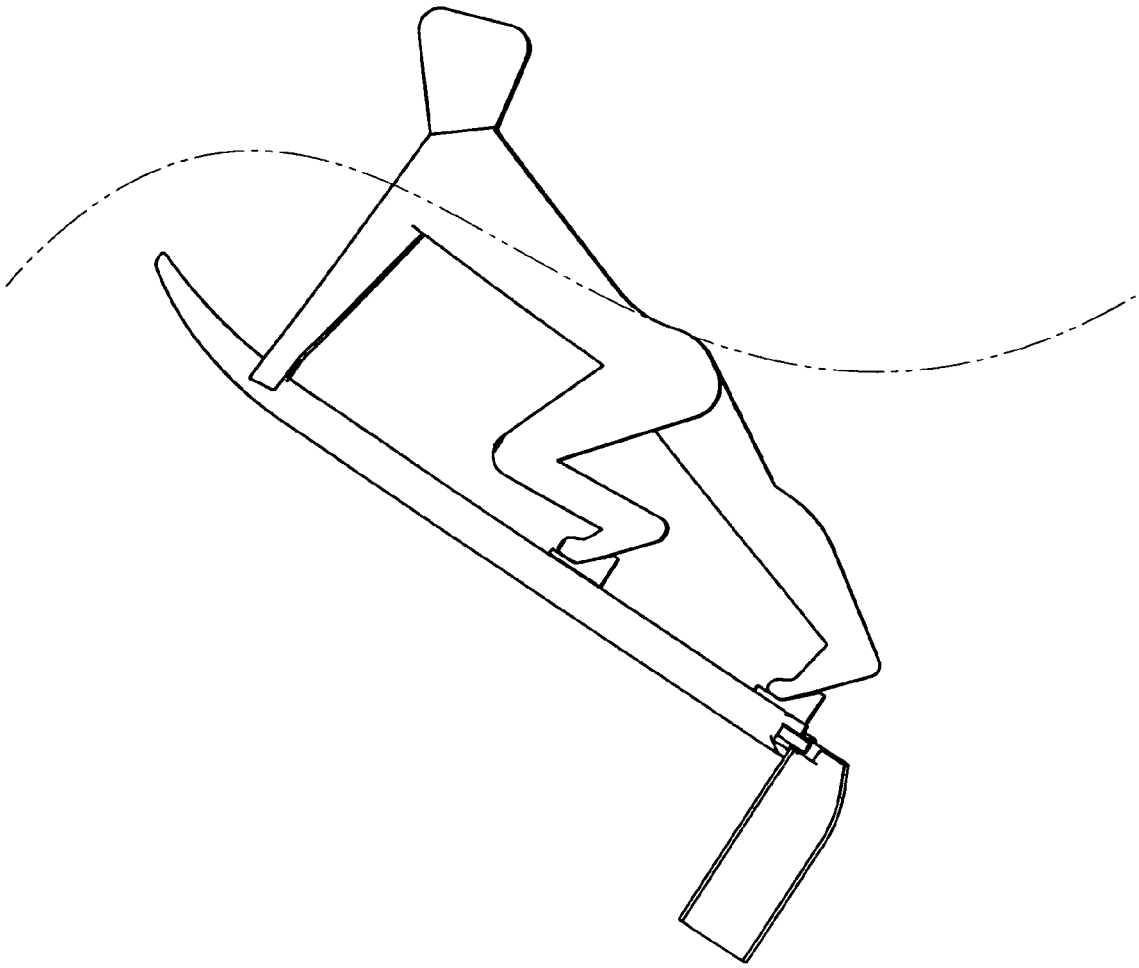
FIG. 11 shows a user ascending the watercraft of the invention from a depth to the surface of the sea.

FIG. 11 shows a user operating the watercraft of the invention ascending from the depths to breach the surface of the sea; this is accomplished by an activating aft ward movement of the user center of gravity thereby weighting the aft craft portion more than the forward craft portion, inclining the craft to a nose up orientation while below the sea surface and continuing to pedal and thrust the foot engaging means of the craft to thereby ascend and propel the craft from the sea depths to the surface of the sea.

Figure 12:
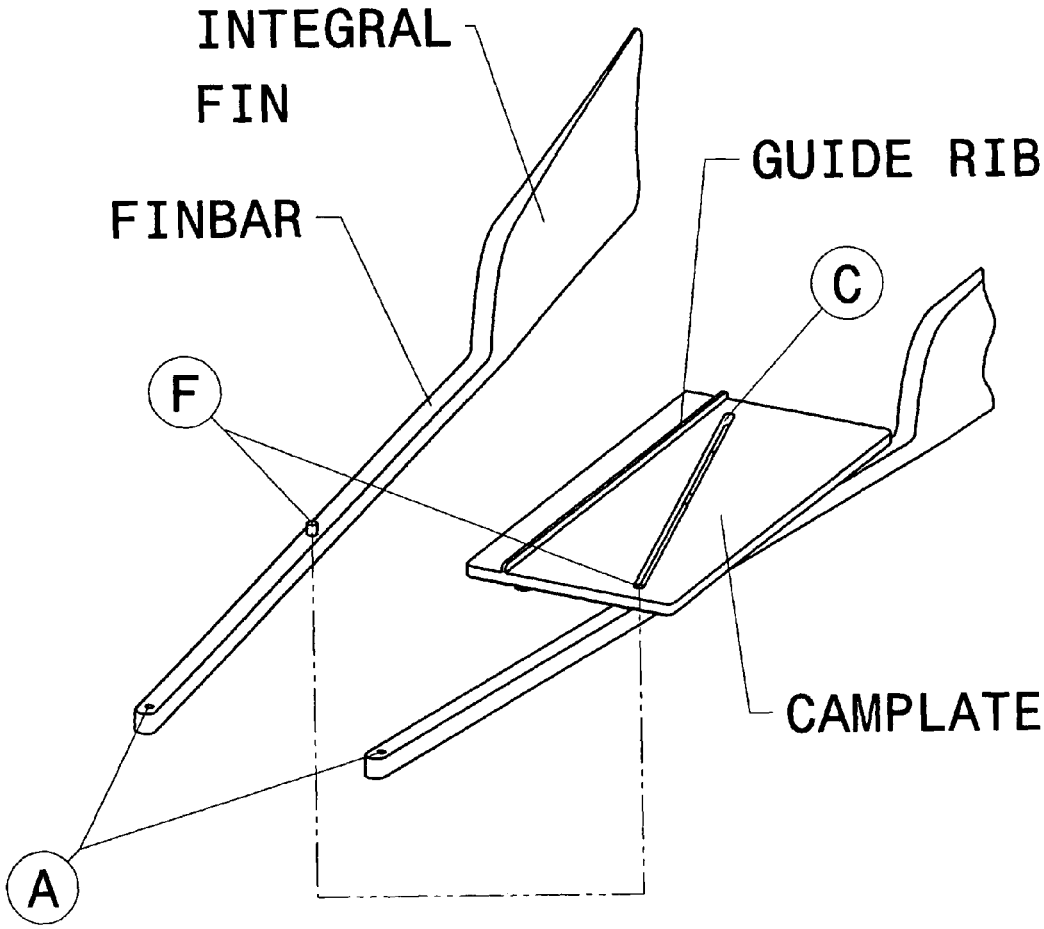
FIG. 12 shows a fin bar and cam plate as they relate to each other inside the invention, the surrounding parts are not shown so to aid in the apprehension of how the system works. The shown cam plate has a guide rib which may usefully fit into a guide slot in a watercraft body whereby the cam plate is stabilized in its translating motion.

FIG. 12 shows an exploded bottom isometric view of a fin bar with integral fin, the fin bar having an aperture (A) at a forward portion of the bar and a cam follower (F) at a portion of the bar. The cam follower inserts to the cam (C) slot in the cam plate. The cam plate is advantageously fitted with a guide rib to interface with a slot in a craft body by which guidance and stability of the cam plate may be increased.

Figure 13:
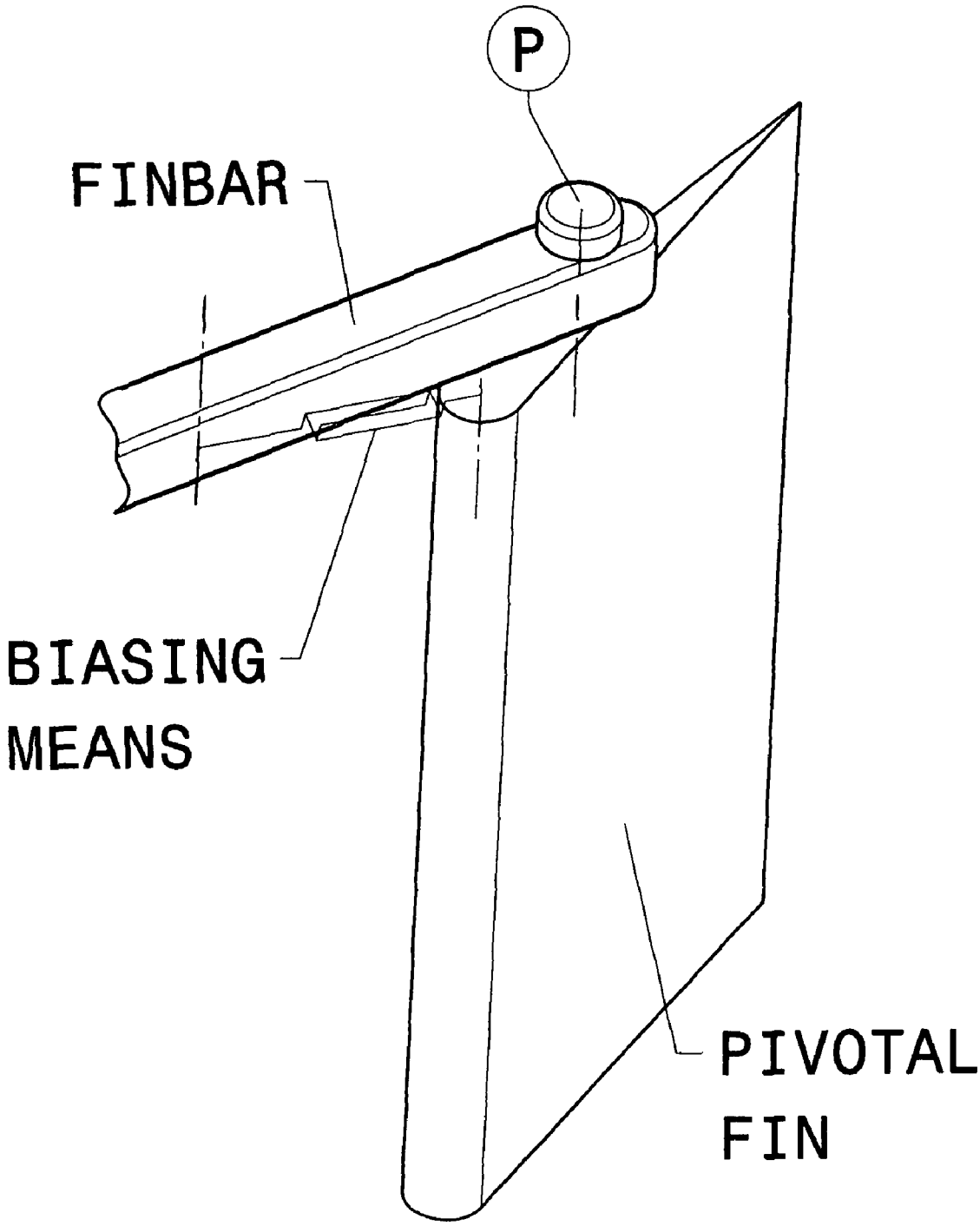
FIG. 13 shows an aft portion of a fin bar, a pivotal fin, the pivot, and spring biasing means.

FIG. 13 shows an isometric view of a fin bar, pivotal fin, and pivot interconnecting the fin bar and pivotal fin and a spring or biasing means interconnecting the fin bar and pivotal fin.

FIG. 14A shows an isometric view with hidden lines shown of a hollow surfboard, the hollow being open to the sea at the aft end of the surfboard. The surfboard body 1 has a plurality of apertures (A) connecting the deck to the hollow and an opening connecting the deck to the hollow. The hollow may advantageously receive a variable buoyancy means or buoyancy compensator and may also receive the propulsion device of the invention. The surfboard hollow may advantageously have guide slots to receive and guide cam plates when the board is used to receive the propulsion device of the invention.

FIG. 14B shows the hollow surfboard of FIG. 14A without hidden lines.

FIG. 15 shows an isometric view of a cam plate having a plate portion with a cam slot in the plate; a pedal means for engaging a foot of a user, an interconnecting portion which connects the pedal means to the plate portion. In addition, the cam plate has a guide rib for engaging a guide slot of a human powered watercraft.

FIG. 16A shows an exploded isometric view of an embodiment of the invention comprised of a surfboard body 1 having a hollow portion, the hollow portion being open to the sea, a plurality of apertures thru at least the deck and connecting the deck to the hollow, a longitudinal opening connecting the deck of the craft to the hollow. Inserted into the hollow of the surfboard body 1 are fin bars 3 and 5 and cam plate 77. Fin bars 3 and 5 have pivot engaging apertures in forward bar portions, and integral fins at aft bar portions, having also cam followers (F) at portions of the bars. The cam followers (F) of the fin bars engage with cam slots in a plate portion of cam plate 77. Cam plate 77 has a single pedal or foot engaging means projecting above the deck of surfboard body 1, the pedal and the plate portion of cam plate 77 being interconnected by a connecting means projecting thru the opening in the deck. The pedal may advantageously have a strap for engaging the feet, although this is not shown.

FIG. 16B top view of the device of FIG. 16A shows elements 1, 3, 5, 77, and the pivots.

FIG. 16C section of the device of FIGS. 16A and 16B shows the cam followers of the fin bars 3 and 5 residing in the cam slots of the cam plate 77.

FIG. 17 isometric shows an aft portion of a fin bar and another aft portion of a fin bar, each linked via a pivot to the dual pivoted fin.

FIG. 18A shows an isometric view of a fin bar having an integral fin at the aft end, and having an aperture at the forward end and a cam follower on a portion of the fin bar.

FIG. 18B shows an isometric view of a fin bar having an aperture at the forward end and an aperture at the aft end, and a cam follower on a portion of the fin bar.

FIG. 19 isometric shows the hollow surfboard 1 with the hollow open to the sea, and a buoyancy compensator, "BC" inserted into the hollow of the surfboard and with a buoyancy compensator air valve protruding thru an aperture in the surfboard.

FIG. 20 partial sectional view isometric shows hollow surfboard 1 having pivot engaging apertures thru the deck and connecting to the hollow; the hollow receives the fin bars 3 and 5 having integral fins at the aft fin bar ends, the fin bars 3 and 5 having pivot engaging apertures at forward fin bar ends and cam followers in a portion of the fin bars. Cam plate 777 substantially spans the breadth of the surfboard hollow across the beam and has at least one cam and a foot engaging pedal; cam plate 777 engages the lower hollow surface of surfboard 1. Cam plate 777 further has a channel for receiving an upper left cam plate 999; cam plate 999 has a cam and a foot engaging pedal and the lower surface of cam plate 999 engages the upper surface of cam plate 777. The cam plates 777 and 999 are operatively engaged by pulley 11 and belt 13 so that a right leg thrust upon the pedal of 777 causes that cam plate to translate aft and causes cam plate 999 to translate forward and urges their respective cams to urge the fin bars to open. An aft thrust of the left leg upon the pedal of 999 causes the process to reverse and close the fins. Propulsive forces are obtained in both opening and closing of the fins and the yawing torque of a fin is equally counterbalanced by that of its opposite while vehicle yaw induced by a leg thrust may be counterbalanced by a lateral force of a user's hand or arm, the force being directed across the bow. Generally, the moving components are amply lubricated by a limitless supply of sea water.

FIG. 21 top view of the device of FIG. 20 shows elements 1, 3, 5, 777, 999, and the pivots and indicates section positions for FIGS. 22A and 22B.

FIG. 22A section of the device of FIGS. 20 and 21 shows that upper cam plate 999 rides upon the upper surface of lower cam plate 777 while the lower surface of cam plate 777 engages the lower hollow surface of craft 1, and fin bars 3 and 5.

FIG. 22B section of the device of FIGS. 20, 21, and 22A shows the cam follower of fin bar 3 protruding into the cam slot of cam plate 777, and the cam follower of fin bar 5 protruding into both the cam slots in upper cam plate 999 and lower cam plate 777.

Many modifications and other embodiments of the invention set forth herein will come to mind to one skilled in the art to which the invention pertains having the benefit of the teachings presented in the foregoing descriptions and associated drawings. By way of exemplifying such modifications without intending to limit the scope of the invention, it can be seen that for example adding rolling element bearings or rollers to the cam plates, the fin bar cam followers, and also to the fin bar portions themselves to preclude the member from bearing upon its neighbor or interface may reduce frictional drag while operating in certain performance ranges. A family of rollers engaging a cam plate with the rollers rolling upon the hollow surfaces of the craft would behave much like a roller seat of a sculling shell, reducing friction and stabilizing the translating motion of the system. It can also be seen that a cam plate can be of a box construction that circumscribes a fin bar with the fin bar residing in the cam box hollow and the cam box may also have upper and lower guide ribs engaging like upper and lower guide channels in a craft body and so again affect a more stabilized translating motion of the propulsion system. Also, the cams may advantageously be of a sinusoidal shape and so create an oscillatory motion of the fins for each pedal thrust. In a race version of the invention, adding a shoulder support in combination with an aerodynamic fairing will reduce both aero drag and the metabolic demands of use and so result in new speed records yet unseen. Further, the deck of the craft can project aft over the fin bars and fins of the device and thereby provide a smooth entry and exit interface for the user. Also, forming hand-holds in the watercraft body or adding handle bars which the user may grasp allows a firm grip is especially desirable in a race craft embodiment. There are many other modifications and combinations of this invention and therefore, it is to be understood that the invention should not to be limited to the specific embodiments disclosed but rather, that the invention is intended to be understood by the scope of the appended claims and their equivalents.

I claim:

1. A system for propulsion of a watercraft having a deck, the system comprising:

a foot engaging cam plate having a pedal portion above the deck and a plate portion below the deck, said plate portion slidingly engaging a lower surface of the watercraft, the plate portion further having at least one cam means for engaging a cam follower of a fin bar, and said foot engaging cam plate having an interconnecting structural portion joining the plate portion and the pedal portion, said interconnecting structural portion projecting thru an opening in the deck of the watercraft, at least one fin bar, the at least one fin bar comprised of a forward bar portion, and an aft bar portion, the at least one fin bar further having a fin coupled to the aft bar portion, the fin being substantially vertical, and the at least one fin bar further having a pivot engaging aperture in the forward fin bar portion, and a cam follower in a portion of the fin bar, the cam follower of the at least one fin bar operatively engaging one cam means in said plate portion of said foot engaging cam plate, at least one aperture thru at least the deck, at least one pivot coupling the at least one fin bar to the at least one aperture thru at least the deck;

whereby, a user may thrust with a leg or, both legs in unison upon the pedal of the cam plate and affect an activating horizontal movement of the cam and generate a sweep of the at least one fin bar across the beam of the craft, deflecting the fin in the water, and propelling the watercraft.

2. The system of claim 1 wherein the foot engaging cam plate has a second cam for engaging a second cam follower of a second fin bar; and a second fin bar comprised of a forward bar portion and an aft bar portion, the second fin bar having a fin coupled to the aft bar portion, the fin being substantially vertical, and the second fin bar further having a pivot engaging aperture in the forward fin bar portion, and a cam follower in a portion of the second fin bar, the cam follower of the second fin bar operatively engaging the second cam of the foot engaging cam plate; and a second aperture thru at least the deck; and a second pivot coupling the second fin bar to the second aperture thru at least the deck.

3. The system of claim 1 further comprising:

Said foot engaging cam plate being configured to interface a left-foot of a user and said foot engaging cam plate is a left-foot engaging cam plate;

and a second foot engaging cam plate having a pedal portion above deck and a plate portion below deck, said plate portion having a cam for engaging a cam follower of a second fin bar, and said second foot engaging cam plate having an interconnecting portion connecting the plate portion and the pedal portion, the interconnecting portion projecting thru an opening in the deck, and said second foot engaging cam plate being configured to interface a right foot of a user and said second foot engaging cam plate is a right foot engaging cam plate;

and said at least one fin bar operatively engaging said one cam of said left foot engaging cam plate, and the at least one fin bar is a first left fin bar;

and a second fin bar having a forward bar portion and an aft bar portion, and a fin coupled to the aft bar portion, and a cam follower in a portion of the fin bar, said second fin bar further having a pivot engaging aperture in the forward bar portion, and the fin bar further being configured to operatively engage a cam of said right foot engaging cam plate, and the second fin bar is a first right fin bar;

at least a second and a third aperture thru at least the deck;

and a pivot coupling the first right fin bar to the deck thru the second aperture;

and a pulley-and-belt system pivoted to the deck thru the third aperture thru at least the deck, said belt of the pulley-and-belt system having a belt first end and a belt second end and a belt middle portion, said belt first end operatively engaging the left foot engaging cam plate and said belt second end operatively engaging the right foot engaging cam plate, and said belt middle portion operatively wrapping said pulley of the pulley-and-belt system.

4. The system of claim 3 further comprised of:

The fin of each fin bar being coupled to the fin bar by integrally molding the fin to the fin bar and the fin of each fin bar being substantially of a molded, flexible and resilient composition of material.

5. The system of claim 3 further comprised of:

Each first left fin bar and each first right fin bar further having a pivot engaging aperture in the aft bar portion of the fin bar, and, the fin being coupled to the aperture in the aft bar portion of the fin bar by a pivot and, each fin of a fin bar and the fin bar being operatively interconnected by a means for biasing the fin to a predetermined orientation with respect to the fin bar.

6. The system of claim 3 further comprised of:

Said first left fin bar has a pivot engaging aperture in the aft bar portion of the fin bar;

and said first left fin bar is joined by a second left fin bar, the second left fin bar having a forward bar portion, and an aft bar portion, and pivot engaging apertures thru the forward and aft bar portions; and said first left fin bar is coupled to the fin by a first fin pivot, and the second left fin bar is coupled to the fin by a second fin pivot; and the second left fin bar is coupled to the deck by another pivot thru a fourth aperture thru the deck; and, said first right fin bar has a pivot engaging aperture in the aft bar portion of the fin bar and, said first right fin bar is joined by a second right fin bar, the second right fin bar having a forward bar portion, and an aft bar portion, and pivot engaging apertures thru the forward and aft bar portions; and said first right fin bar is coupled to the fin by a first fin pivot, and the second right fin bar is coupled to the fin by a second fin pivot; and the second right fin bar is coupled to the deck by another pivot thru a fifth aperture thru the deck.

* * * * *